US006066920A

United States Patent [19]

Torihara et al.

[11] Patent Number: 6,066,920

[45] Date of Patent: May 23, 2000

[54] ILLUMINATION DEVICE, METHOD FOR DRIVING THE ILLUMINATION DEVICE AND DISPLAY INCLUDING THE ILLUMINATION DEVICE

[75] Inventors: Hiroshi Torihara, Yamabe-gun; Takayoshi Tanabe, Tenri; Kenichi Ukai, Uda-gun; Nobuyuki Takahashi, Kawachinagano, all of Japan

[73] Assignee: Sharp Kabushiki Kaisha, Osaka, Japan

[21] Appl. No.: 09/002,673

[22] Filed: Jan. 5, 1998

[30] Foreign Application Priority Data

Jan. 7, 1997 [JP] Japan ..... 9-000995
Aug. 27, 1997 [JP] Japan ..... 9-231515

[51] Int. Cl.[7] ..... H01J 7/44

[52] U.S. Cl. ..... 315/50; 315/112; 315/116; 315/117; 313/595

[58] Field of Search ..... 315/50, 51, 112, 315/115–118; 313/594–596, 601; 349/61, 62, 70, 72; 345/102; 362/31, 330; 385/901

[56] References Cited

U.S. PATENT DOCUMENTS 4,029,989 6/1977 Fellows ..... 315/51
4,645,974 2/1987 Asai ..... 315/50

FOREIGN PATENT DOCUMENTS 2 324 122 4/1977 France .
53-45072 4/1978 Japan .
59-60880 4/1984 Japan .
61-74298 4/1986 Japan .
63-224140 9/1988 Japan .
64-43964 2/1989 Japan .
4-370649 12/1992 Japan .
5-249432 9/1993 Japan .
5-251046 9/1993 Japan .
6-283142 10/1994 Japan .
7-43680 2/1995 Japan .
7-183092 7/1995 Japan .
7-211468 8/1995 Japan .

*Primary Examiner*—Haissa Philogene
*Attorney, Agent, or Firm*—Nixon & Vanderhye P.C.

[57] ABSTRACT

An illumination device includes a cold cathode fluorescent tube having a heat capacity of 0.035 Wsec/° C. or less per unit length (1 cm) of a glass tube of a fluorescent section of the cold cathode fluorescent tube. The illumination device has a superior operation characteristic at a low temperature. The device is driven by a method and is implemented in a display device.

23 Claims, 19 Drawing Sheets

$y \geqq 0.5x$ y: Heat generation per unit volume of glass tube of fluorescent section [W/cm³]

x: Fluorescent tube current [mArms]

Ambient temperature−30°C
100% luminance after 15 mins. from start−up

Influence of heat generation difference between tubes on prescribed luminance

ILLUMINATION DEVICE, METHOD FOR DRIVING THE ILLUMINATION DEVICE AND DISPLAY INCLUDING THE ILLUMINATION DEVICE

BACKGROUND OF THE INVENTION

1. Field of the Invention

The present invention relates to an illumination device having a cold cathode fluorescent tube, and a display device including the illumination device.

2. Description of the Related Art

In liquid crystal display devices such as those for use in on-vehicle navigators, on-vehicle televisions and on-vehicle meters, direct backlights and edge light illumination devices have been widely used. A cold cathode fluorescent tube is used as a light source of such illumination devices for the liquid crystal display devices. The cold cathode florescent tube has advantages over an incandescent lamp such as excellent luminous efficacy, a lesser amount of heat generation, a longer life, and superior luminance (luminous flux) distribution. Moreover, the cold cathode fluorescent can be formed as a thin element.

However, a conventional cold cathode fluorescent tube which has been generally used has a disadvantage that the characteristics thereof are affected by the temperature at which the cold cathode fluorescent tube is used. This results from the fact that the characteristics of the conventional cold cathode fluorescent tube depend on the vapor pressure of mercury which fills the tube. A luminance (luminous flux) rising characteristic (i.e., a "start-up" characteristic) at a low temperature and luminance at a low temperature are most seriously affected. For example, on-vehicle illumination devices may be used at a broad range of temperatures from about 80° C. to about −30° C. (from the tropics to the Polar Regions). The above-mentioned conventional cold cathode fluorescent tube has maximum luminous efficacy at an ambient temperature of about 40° C., and therefore, can be practically used without any problems at a temperature between about 5° C. to about 40° C. However, when used at a low temperature close to −30° C., the conventional cold cathode fluorescent tube might require a long time to achieve prescribed luminance, or might easily fail to start.

In order to facilitate the rise of the luminance at a low temperature as well as to improve the luminance at a low temperature, Japanese Laid-Open Publication No. 63-224140 discloses a structure in which an exothermic body which self-controls its temperature is provided around a cold cathode fluorescent tube so as to increase a surface temperature of the cold cathode fluorescent tube. In addition, Japanese Laid-Open Publication No. 7-43680 discloses a structure in which a heater for heating a cold cathode fluorescent tube is provided. Power supplied to the heater is controlled by continuous measuring of a surface temperature of the cold cathode fluorescent tube by a temperature detection element and a temperature detection circuit, thereby effecting control of a heater power supply and an inverter power supply.

More specifically, the above-mentioned conventional example employs a method for controlling power supplied to the heater so as to render the cold cathode fluorescent tube stable in a saturation temperature range (i.e., stable in a temperature environment).

Moreover, a method for increasing a current applied to a cold cathode fluorescent tube only during start-up so as to improve the rise of luminance at a low temperature has also been proposed. For example, Japanese Laid-Open Publication No. 61-74298 discloses a structure in which control means increases a current applied to a cold cathode fluorescent tube to a value larger than a rated value only for a prescribed period from the start to completion of the rise of luminance.

In addition, Japanese Laid-Open Publication No. 59-60880 discloses a method for increasing an interrupting current for a switching circuit for a prescribed period from activation so as to increase an energy of the fluorescent tube.

However, the above-mentioned conventional examples have the following problems.

In the case where such an exothermic body or a heater is used to heat a cold cathode fluorescent tube, large luminous flux losses will occur, and therefore, the amount of illumination light will be reduced. Such luminous flux losses occur because the exothermic body or the heater itself is in close contact with a surface of the cold cathode fluorescent tube and thus blocks the luminous flux of the cold cathode fluorescent tube. Moreover, should a control circuit for the heater malfunction, the heater would continue to generate heat. Furthermore, the heater itself and its associated parts including a control circuit, would be additionally required, causing a significant increase in the manufacturing cost. Moreover, additional power (typically, several tens of watts) required for the heater would impose a load to the battery as well as affect the vehicle itself when, for example, the on-vehicle illumination device is started. Especially in winter, since a battery temperature may be below 0° C., such a load to the battery and an influence on the vehicle can not be ignored.

In the case where the above-mentioned method for increasing a current applied to the cold cathode fluo- rescent tube for a prescribed period from activation so as to facilitate start-up at a low temperature is used, a current larger than a rated value is applied to the cold cathode fluorescent tube upon activation, and the cold cathode fluorescent tube could be damaged seriously. Therefore, a life of the cold cathode fluorescent tube would be reduced. Moreover, this method does not sufficiently improve the rise of the luminance at a low temperature as compared to the above-mentioned method of using the heater. Therefore, this method is often used together with the method of using the heater.

Consequently, there is a demand for the development of display devices such as a liquid crystal display device using a cold cathode fluorescent lamp as a light source, which can provide required luminance even when the display devices are used in a broad temperature range from about 80° C. to about −30° C. (i.e., from the tropics to the Polar Regions).

SUMMARY OF THE INVENTION

According to one aspect of the present invention, an illumination device includes a cold cathode fluorescent tube having a heat capacity of about 0.035 Wsec/° C. or less per unit length (1 cm) of a glass tube of a fluorescent section of the cold cathode fluorescent tube.

In one embodiment, a structure-factor time constant $\tau s$ given by a product of heat resistance R (° C./W) and the heat capacity C (Wsec/° C.) per unit length (1 cm) of the glass tube of the fluorescent section of the cold cathode fluorescent tube is about 11 seconds or less, where $R=(Ts-T)/\{(Vccft-vp)\cdot Iccft/L\}$, Vccft is a voltage (Vrms) across the cold cathode fluorescent tube, Vp is a voltage drop (Vrms) between electrodes of the cold cathode fluorescent tube, Iccft is a current (Arms) applied to the cold cathode fluorescent tube, L is a length (cm) of the cold cathode fluorescent tube, T is an ambient temperature (° C.), and Ts is a saturation temperature (° C.) of a wall of the cold cathode fluorescent tube, the saturation temperature being a temperature reached when the wall of the cold cathode fluorescent tube attains a steady state while the cold cathode fluorescent tube is in operation.

In one embodiment, a relation $Dt/Dg<2/da$ is satisfied where a cross sectional area of the glass tube of the cold cathode fluorescent tube is represented by Dt ($mm^2$), a cross sectional area of a gas-filled portion of the cold cathode fluorescent tube is represented by Dg ($mm^2$), and an inner diameter of the glass tube is represented by da ($mm^2$).

In another embodiment, a relation $Wv/Iccft \geqq 0.5$ is satisfied where an amount of heat generation per unit volume (1 $cm^3$) of the glass tube of the fluorescent section of the cold cathode fluorescent tube is represented by Wv(W) and a current across the cold cathode fluorescent tube is represented by Iccft (mArms).

A time constant $\tau$ for a luminance rise of the cold cathode fluorescent tube preferably satisfies a relation $\tau \geqq -0.0006T^3+0.0288T^2-0.4668T+26.8$ at an ambient temperature T (° C.) upon start-up of the cold cathode fluorescent tube ranging from −10° C. to +25° C.

A pre-exponential factor A of a luminance rising characteristic of the cold cathode fluorescent tube may satisfy a relation $A \geqq 0.92T+60$ within the start-up ambient temperature range, the preexponential factor A being represented as a percentage with respect to a pre-exponential factor A0 of saturation relative luminance.

In still another embodiment, the activation energy of the pre-exponential factor of the cold cathode fluorescent tube is about 3.0 kcal/mol or less within the start-up ambient temperature range.

In yet another embodiment, about 95% or more of a total surface area of the fluorescent section of the cold cathode fluorescent tube is exposed to air, and about 50% or more of light emitted from the cold cathode fluorescent tube is utilized for illumination.

The illumination device may further include a polarization selective reflection sheet provided on a light-emitting side of the cold cathode fluorescent tube.

A constant current is preferably applied to the cold cathode fluorescent tube during operation of the illumination device.

In another embodiment, the illumination device further includes a temperature detector for detecting an ambient temperature of the cold cathode fluorescent tube; and an operation apparatus for setting a prescribed current applied to the cold cathode fluorescent tube, based on the temperature detected by the temperature detector. The current applied to the cold cathode fluorescent tube is controlled based on an ambient temperature upon start-up of the cold cathode fluorescent tube.

According to another aspect of the present invention, a method for driving an illumination device according to one aspect of the present invention includes the steps of detecting an ambient temperature of the cold cathode fluorescent tube by the temperature detector; setting a prescribed current applied to the cold cathode fluorescent tube, based on the temperature detected by the temperature detector; and thereby controlling the current applied to the cold cathode fluorescent tube, based on an ambient temperature upon start-up of the cold cathode fluorescent tube.

According to still another aspect of the present invention, a display device includes an illumination device according to the one aspect of the present invention, and a transmission-type display element for receiving light emitted from the illumination device.

In one embodiment, the transmission-type display element is a liquid crystal display device.

In yet another aspect of the present invention, an illumination device including a cold cathode fluorescent tube includes a temperature sensor thermally coupled to the cold cathode fluorescent tube, wherein luminance is adjusted by controlling power supplied to the cold cathode fluorescent tube based on a sensed-temperature signal from the temperature sensor.

In one embodiment, the temperature sensor is provided at a portion of a wall of the cold cathode fluorescent tube.

In another embodiment, the wall is a wall located in a direction outward within the illumination device.

In still another embodiment, the temperature sensor is provided at a corner of a display plane.

Luminance may be adjusted by approximating a relation between luminance and a temperature sensed by the temperature sensor by one of expressions of a first order which are provided for respective temperature ranges, and by controlling a duty ratio of the power supplied to the cold cathode fluorescent tube based on the expression.

Luminance may be adjusted by approximating a relation between luminance and a temperature sensed by the temperature sensor by a polynomial, and controlling a duty ratio of the power supplied to the cold cathode fluorescent tube based on the polynomial.

In another embodiment, a larger amount of power is supplied to the cold cathode fluorescent tube upon start-up than during a normal operation.

In still another embodiment, a heat capacity of the cold cathode fluorescent tube is reduced by decreasing a diameter of the cold cathode fluorescent tube as much as possible or by decreasing a size of the cold cathode fluorescent tube as much as possible.

According to yet another aspect of the present invention, a display device uses an illumination device according to the yet another aspect of the present invention.

In one embodiment, the illumination device includes a temperature sensor thermally coupled to the cold cathode fluorescent tube, wherein luminance is adjusted by controlling power supplied to the cold cathode fluorescent tube based on a sensed-temperature signal from the temperature sensor.

According to yet another aspect of the present invention, a method for driving an illumination device according to the one aspect of the present invention includes the steps of sensing a temperature of the cold cathode fluorescent tube, and controlling power supplied to the cold cathode fluorescent tube, based on the sensed temperature, thereby adjusting luminance.

Function of the present invention will now be described.

A cold cathode fluorescent tube included in an illumination device of the present invention has a heat capacity smaller than that of a conventional cold cathode fluorescent lamp. Energy applied to the cold cathode fluorescent tube is not only used for light emission but is released as heat. Accordingly, a smaller heat capacity of the cold cathode fluorescent tube has an advantage that the cold cathode fluorescent tube can be rapidly heated by using heat generated from the cold cathode fluorescent tube itself.

In addition, the cold cathode fluorescent tube included in the illumination device of the present invention generates more heat than the conventional cold cathode fluorescent tube, and therefore, the cold cathode fluorescent tube can be heated rapidly.

Moreover, the illumination device of the present invention includes a polarization selective reflection sheet, and therefore, the illumination device can efficiently utilize light, emitted from the cold cathode fluorescent tube, for illumination.

Moreover, the illumination device of the present invention has such a structure that power supplied to the cold cathode fluorescent tube is controlled by a temperature sensed by a temperature sensor which is thermally coupled to the cold cathode fluorescent tube. Therefore, intended brightness can be obtained at any ambient temperature. It is noted that "thermally coupled" herein means that the temperature sensor is provided at such a position that the temperature sensor is approximately in thermal equilibrium with the cold cathode fluorescent tube.

The reason for this is as follows. The cold cathode fluorescent tube used as a light source is affected by an ambient temperature. However, in the case where thermal equilibrium is achieved with constant power being supplied to the cold cathode fluorescent tube, a parameter which determines brightness of the cold cathode fluorescent tube that is, luminance of the cold cathode fluorescent tube depends on the vapor pressure of mercury filling the cold cathode fluorescent tube. Therefore, the brightness will be a function of only an equilibrium temperature.

Moreover, such a method of controlling power to be supplied to the cold cathode fluorescent tube by a sensed temperature will not be affected by an ambient temperature. Accordingly, control can be conducted immediately after start-up.

This power control is realized as follows. In a first method, a relation between a temperature sensed by a temperature sensor and intended luminance is approximated by one of expressions of the first order which are provided for respective prescribed temperature ranges; and thereafter, a duty ratio of power supplied to the cold cathode fluorescent tube is controlled for achieving the intended luminance, based on the approximation expression of the first order. In a second method, a relation between a temperature sensed by the temperature sensor and intended luminance is approximated by a polynomial; and thereafter, a duty ratio of power supplied to the cold cathode fluorescent tube is controlled for achieving the intended luminance, based on the polynomial approximation.

In the case where the illumination device is structured such that a larger amount of power is supplied to the cold cathode fluorescent tube upon start-up than during a normal operation, a start-up characteristic of the cold cathode fluorescent tube can be improved. As a result, intended luminance can be achieved rapidly.

Thermal equilibrium is not achieved right after start-up. However, in the case where the cold cathode fluorescent tube is reduced as much as possible in diameter or in size, a heat capacity of the cold cathode fluorescent tube will be reduced. Therefore, the difference between an actual temperature within the cold cathode fluorescent tube and a temperature sensed by the temperature sensor is decreased. As a result, intended brightness can be obtained rapidly by controlling power supplied to the cold cathode fluorescent tube according to the sensed temperature.

In the case where a cold cathode fluorescent tube generating a large amount of heat is used, the cold cathode fluorescent tube can be heated rapidly. As a result, intended brightness can be obtained rapidly.

In addition, as opposed to the case of a heater, the temperature sensor does not need to be provided over the whole surface of the cold cathode fluorescent tube. The temperature sensor only needs to be provided at a portion of the cold cathode fluorescent tube. With such a structure, luminous flux can be effectively utilized.

Thus, the invention described herein makes possible the advantages of:

(1) providing an illumination device having excellent operation characteristics at a low temperature, a method for driving the illumination device, and a display device using the illumination device;

(2) providing an illumination device capable of providing stable light-modulation characteristics even when the illumination device is used in a broad range of temperatures, and therefore, capable of eliminating adverse effects of an ambient temperature on the light-modulation characteristics, a method for driving the illumination device, and a display device including the illumination device;

(3) providing an illumination device capable of controlling light modulation immediately after the start-up, a method for driving illumination device, and a display device including the illumination device; and (4) providing an illumination device capable of significantly reducing a time period required to achieve intended luminance, a method for driving the illumination device, and a display device including the illumination device.

These and other advantages of the present invention will become apparent to those skilled in the art upon reading and understanding the following detailed description with reference to the accompanying figures.

DESCRIPTION OF THE PREFERRED EMBODIMENTS

Embodiment 1

Figure 1A:
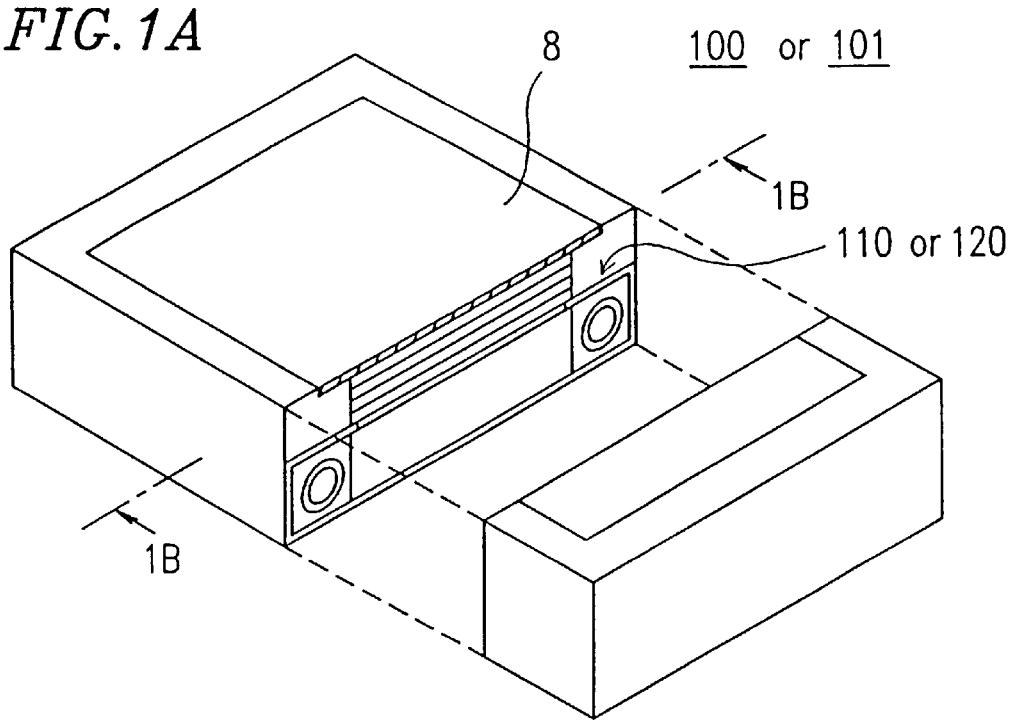
FIG. 1A is a schematic diagram showing a display device 100 according to the present invention.

A first embodiment of the present invention will now be described. A display device 100 of the present invention is shown in FIG. 1A. FIG. 1A is a schematic diagram showing the display device 100, including an illumination device 110 and a transmission-type display element (for example, a liquid crystal display element) 8.

Figure 1B:
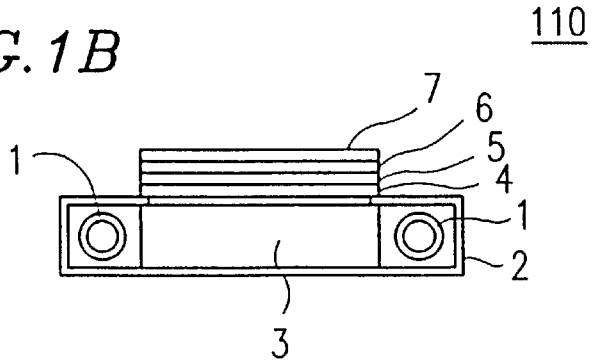
FIG. 1B is a cross sectional view taken along the line 1B—1B of FIG. 1A, showing an illumination device 110 included in a display device 100 of a first embodiment of the present invention.

FIG. 1B is a cross sectional view taken along the line 1B—1B of FIG. 1A, showing the illumination device 110 included in the display device 100. The illumination device 110 includes a cold cathode fluorescent tube 1 with a small heat capacity and large heat generation, which will be described later, a reflection sheet 2, a light guiding element 3, a diffusion sheet 4, a prism sheet 5 (for example, a BEF sheet made by 3M inc.), a polarization selective reflection sheet 6, and a diffusion sheet 7. The illumination device 110 of the present invention is different from a conventional illumination device in that the illumination device 110 of the present invention has the cold cathode fluorescent tube 1 with a small heat capacity and large heat generation and also has the polarization selective reflection sheet 6.

The cold cathode fluorescent tube 1 with a small heat capacity and large heat generation herein refers to a cold cathode fluorescent tube which has a smaller heat capacity as well as generates a larger amount of heat as compared to the conventional cold cathode fluorescent tube. In the structure shown in FIGS. 1A through 1C, most of a surface of a fluorescent section of the cold cathode fluorescent tube 1 is exposed to air, whereby the fluorescent section is sufficiently thermally isolated from the other components. Therefore, the features of the cold cathode fluorescent tube 1, that is, a small heat capacity and large heat generation, can be effectively utilized. In order to achieve sufficient thermal isolation, it is preferable that about 95% of the total surface area of the cold cathode fluorescent tube 1 is exposed to air. More preferably, about 98% of the total surface area is exposed to air. It is also preferable, in view of efficiency to structure the illumination device 110, that about 50% or more of light from the cold cathode fluorescent tube 1 is guided by the light-guiding element 3 to be used for illumination. A position of the cold cathode fluorescent tube 1 is determined in consideration of both the light utilization efficiency and the thermal isolation.

It is noted that the polarization selective reflection sheet 6 may be located between the diffusion sheet 4 and the prism sheet 5, and that the diffusion sheet 7 may be omitted. The polarization selective reflection sheet 6 may also be omitted as required according to applications. In the case where a display element utilizing only specific linearly polarized light, such as a liquid crystal display element, is used, luminance can be improved by using the polarization selective reflection sheet 6.

Features of the illumination device and the display device according to the present invention will now be described in detail. The illumination device and the display device of the present invention are not limited to the structure described above. As can be seen from the following description, the components having respective individual features can be separately used as appropriate according to applications.

(Cold Cathode Fluorescent Tube with a Small Heat Capacity)

The illumination device according to the present invention includes a cold cathode fluorescent tube having a small heat capacity. Such a cold cathode fluorescent tube prevents heat energy generated within the cold cathode fluorescent tube from being released outside itself, whereby the cold cathode fluorescent tube itself can be heated rapidly.

Normally, heat energy released from the cold cathode fluorescent tube is not utilized effectively for heating the cold cathode fluorescent tube itself. This is because the heat is absorbed by a glass tube forming the cold cathode fluorescent tube and propagated within the glass tube. Such absorption and propagation of the heat occurs because a heat capacity of the glass tube forming the conventional cold cathode fluorescent tube is too large with respect to the amount of heat generated by the cold cathode fluorescent tube.

When the heat capacity of the glass tube used in the cold cathode fluorescent tube is reduced, the glass tube will be heated rapidly, and therefore, the inside of cold cathode fluorescent tube can be heated rapidly. The cold cathode fluorescent tube according to the present invention is a cold cathode fluorescent tube having a heat capacity C of about 0.035 Wsec/° C. or less per unit length (1 cm) of the glass tube, the heat capacity C being defined by the following expression (1). In particular, the cold cathode fluorescent tube wherein the glass tube has an inner diameter da of about 0.20 cm or less is preferred.

$$C=4.2\cdot(\pi/4)\cdot\{(db^2-da^2)\cdot s1\cdot\delta 1\} \quad (1)$$

In the above expression (1), C represents a heat capacity (Wsec/° C.) of the glass tube, db represents an outer diameter (cm) of the glass tube, da represents an inner diameter (cm) of the glass tube, s1 represents specific heat (cal/g·° C.), and δ1 represents a density (g/cm$^3$) of a glass material.

Typical values of the above-mentioned parameters for the glass tube of the cold cathode fluorescent tube used in the present invention and a conventional glass tube are shown in the following Table 1. The values shown in Table 1 are those per unit length (1 cm) of the glass tube, while a glass tube wherein a distance between electrodes is 15 cm was used in the experiment.

TABLE 1

| Characteristic value | Present invention | Conventional example |
|---|---|---|
| C(Wsec/°C.) | 0.0290 | 0.0526 |
| C(cal/°C.) | 6.92E-3 | 1.25E-2 |
| db(cm) | 0.26 | 0.30 |
| da(cm) | 0.20 | 0.20 |
| glass thickness(cm) | 0.03 | 0.05 |
| s1(ca1/g · °C.) | 0.14 | 0.14 |
| δ1(g/cm$^3$) | 2.28 | 2.28 |

As shown in Table 1, the heat capacity C of the cold cathode fluorescent tube according to the present invention has a very small value, that is, about 55% of the heat capacity of the conventional cold cathode fluorescent tube. As a result, the cold cathode fluorescent tube of the present invention itself is effectively heated upon activation by heat generated by the cold cathode fluorescent tube. Accordingly, the rising characteristic of luminance can be improved.

A preferred range of the heat capacity of the cold cathode fluorescent tube used in the present invention can also be defined by a simpler expression. When a cross sectional area of a gas-filled portion of the cold cathode fluorescent tube is represented by Dg (which is determined by an inner diameter of the glass tube), and a cross sectional area of the glass tube of the cold cathode fluorescent tube is represented by Dt (which is determined by inner and outer diameters of the glass tube), it is more advantageous to use a cold cathode fluorescent tube having a smaller Dt when a Dg is the same (i.e., when the amount of heat energy generated from a gas filling the cold cathode fluorescent tube is the same). This is because heat generated by the cold cathode fluorescent tube can be more effectively utilized for heating the cold cathode fluorescent tube itself. In other words, it is more advantageous to use the cold cathode fluorescent tube having a smaller value of Dt/Dg. Values of these parameters for the same cold cathode fluorescent tubes as those in Table 1 are shown in the following Table 2.

TABLE 2

| | Present invention | Conventional example |
|---|---|---|
| Dg(mm$^2$) | 3.14 | 3.14 |
| Dt(mm$^2$) | 2.167 | 3.925 |
| Dt/Dg | 0.69 | 1.25 |

A value of Dt/Dg of the cold cathode fluorescent tube used in the present invention is preferably about 1.0 or less. This relation can be defined generally by the expression Dt/Dg<2/da (per 1 mm). Moreover, a smaller surface area of the glass tube is preferred in order to reduce heat energy losses through the surface of the glass tube of the cold cathode fluorescent tube. It is also preferable that the glass tube is not in contact with any other members of the illumination device and is thermally isolated therefrom by air.

Now, the thermal resistance R of the glass tube is considered. The thermal resistance R of the glass tube is given by the following expression (2):

$$R=1/K \quad (2)$$

$$K=(hw+hr\cdot\eta o)\cdot\pi\cdot db \quad \text{(theoretical expression)}$$

$$K=\{(Vccft-Vp)\cdot Iccft/L\}/(Ts-T) \quad \text{(experimental expression)}$$

where R represents thermal resistance (° C./W), K represents thermal conductivity (W/° C.), hw represents a coefficient (W/° C.·cm$^2$) of heat dissipation due to convection, hr represents a coefficient (W/° C.·cm$^2$) of heat dissipation due to radiation, ηo represents a ratio of a radiation coefficient of a material to a radiation coefficient of a perfect black body, db represents an outer diameter (cm) of the glass tube, Vccft represents a voltage (Vrms) across the cold cathode fluorescent tube, Vp represents a voltage drop (Vrms) between electrodes of the cold cathode fluorescent tube, Iccft represents a current (Arms) across the cold cathode fluorescent tube, L represents a length (cm) of the fluorescent tube, Ts represents a saturation temperature (° C.) of a wall of the cold cathode fluorescent tube, and T represents an ambient temperature (° C.). A saturation temperature Ts herein indicates a temperature reached when the wall temperature of the cold cathode fluorescent tube attains a steady state. In general, the thermal conductivity K can not be obtained from the above-mentioned theoretical expression. Therefore, the thermal conductivity K was obtained based on the above-mentioned experimental expression.

For the glass tube having an outer diameter db of 0.26 cm as shown in Tables 1 and 2, thermal resistance R was calculated for different values of Vccft, Iccft and T, using the above-mentioned experimental expression of the expression (2). In this case, Vp was 150 V, L was 16.5 cm, and T was 25° C.

In addition, a heat dissipation coefficient hw is proportional to an outer diameter db of the glass tube raised to the −¼th power. Therefore, the thermal conductivity K calculated from the above-mentioned theoretical expression is proportional to the outer diameter db raised to the ¾th power. The thermal conductivity K for the glass tube having an outer diameter db of 0.30 was calculated by multiplying the experimental values for the glass tube having an outer diameter db of 0.26 by a conversion factor 1.113. This result is also shown in the following Table 3.

TABLE 3

| Iccft(A) | Vccft(V) | T(°C.) | Present invention db = 0.26 K(W/°C.) | Conventional example db = 0.30 K(W/°C.) |
|---|---|---|---|---|
| 0.005 | 430 | 51.5 | 0.00320 | 0.00356 |
| 0.007 | 395 | 55.5 | 0.00341 | 0.00379 |
| 0.010 | 360 | 60.5 | 0.00359 | 0.00399 |

As can be seen from Table 3, the thermal conductivity of the cold cathode fluorescent tube of the present invention is smaller than that of the conventional cold cathode fluorescent tube by 10% or more, and therefore, heat is less likely to be released by the cold cathode fluorescent tube of the present invention. In other words, the cold cathode fluorescent tube of the present invention itself can be heated more efficiently than the conventional cold cathode fluorescent tube when both fluorescent tubes generate the same amount of heat.

Next, a time constant of the rise of luminance of the cold cathode fluorescent tube is considered. A time constant τs of the luminance rise per unit length (1 cm) of the glass tube is given by the following expression (3) using a heat capacity C and heat resistance R per unit length (1 cm) of the glass tube. This time constant is determined by a structure of the cold cathode fluorescent tube, and therefore, is herein specifically referred to as a structure-factor time constant τs.

$$\tau s = C \cdot R \quad (3)$$

The resultant values obtained for the respective cold cathode fluorescent tubes of the present invention (db=0.26 cm) and the conventional example (db=0.30 cm) will be shown in the following Table 4.

TABLE 4

| | Present invention db = 0.26 | Conventional example db = 0.30 |
|---|---|---|
| τs (sec) | 9.08 | 14.77 |
| C (Wsec/°C.) | 0.00291 | 0.00526 |
| R (°C./W) | 312.3 | 280.5 |

Note that the values R in Table 4 were obtained from the values K in the above Table 3. As can be seen from Table 4, the time constant τs of the cold cathode fluorescent tube of the present invention is very short as compared to that of the conventional example, and therefore, the cold cathode fluorescent tube of the present invention can be heated more easily. A time constant τs of a cold cathode fluorescent tube which is preferably used in the present invention is preferably about 11 seconds or less.

Figure 2:
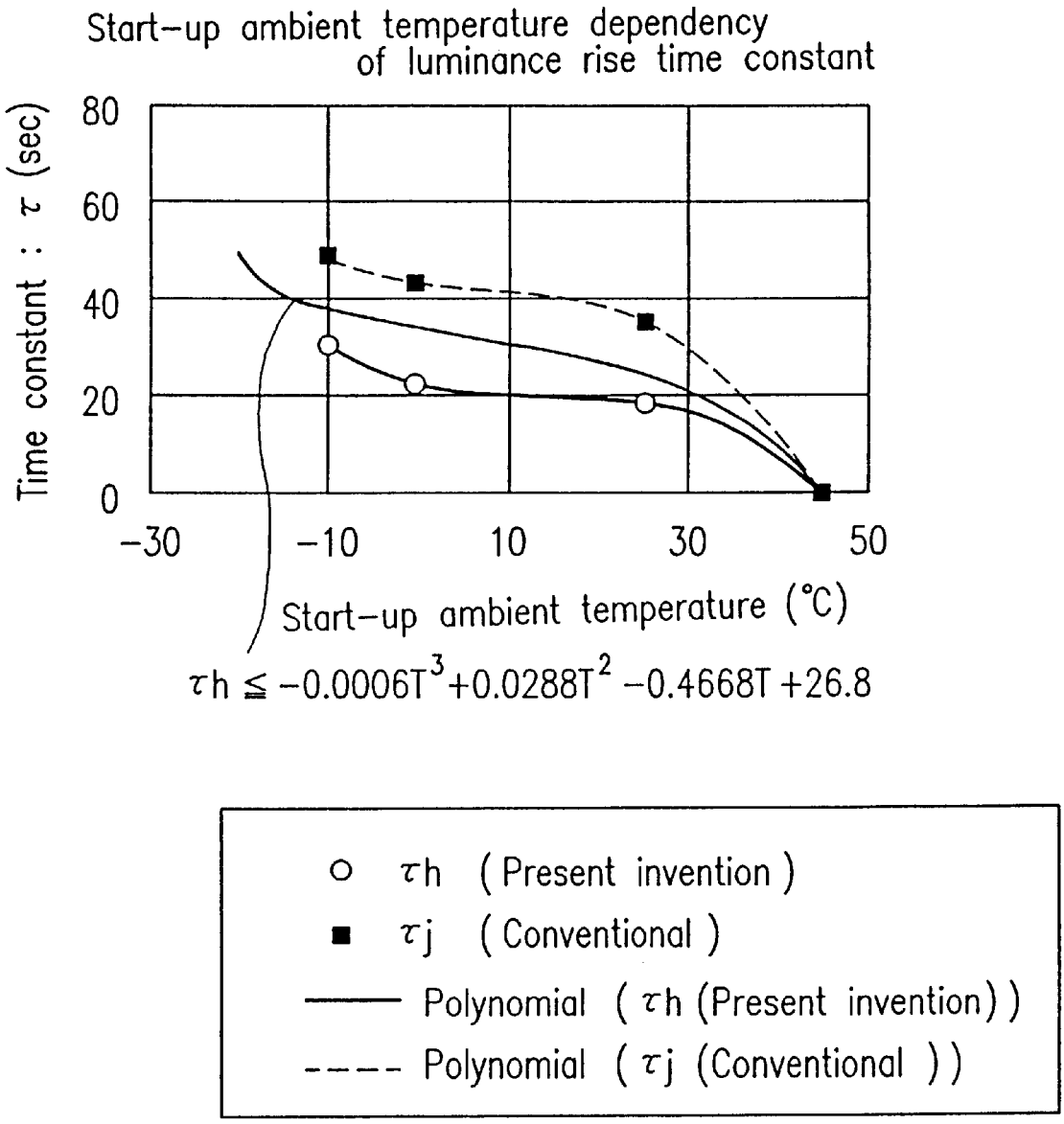
FIG. 2 is a graph showing dependency of a time constant for a luminance rise of the first embodiment of the present invention and a conventional example on an ambient temperature upon start-up.

Actual time constants τ (measured values; per second) of the rise of luminance at various temperatures were obtained for the respective cold cathode fluorescent tubes of the present invention and the conventional example. The result is shown in FIG. 2 and in the following Table 5. This time constant τ is herein referred to as a measured time constant. In FIG. 2, τh and τj indicate respective measured time constants for the cold cathode fluorescent tubes of the present invention and the conventional example.

TABLE 5

| Ambient temperature (°C.) | Present invention db = 0.26 | Conventional example db = 0.30 |
|---|---|---|
| −20 | | |
| −10 | 30.0 | 48.0 |
| 0 | 21.8 | 43.3 |
| 25 | 18.0 | 34.5 |

As can be seen from Table 5, the cold cathode fluorescent tube of the present invention has a shorter time constant τ than that of the conventional example, and therefore, the cold cathode fluorescent tube of the present invention is heated faster than that of the conventional example. As described above, a time constant τs can be used for relative evaluation of the rising characteristics of luminance of the cold cathode fluorescent tubes. However, as can be seen from the fact that the values τs shown in the above Table 4 are different ent from the values τ in Table 5, an actual time constant of the rise of luminance can not be correctly evaluated using only the structure of a cold cathode fluorescent tube.

With reference to FIG. 2, a range of time constants τ used preferably in the cold cathode fluorescent tube of the present invention were obtained. Measured values were approximated by a polynomial of the third order (curve fitting). Then, a boundary curve of the preferred time constants τ was obtained based on the curve obtained by the curve fitting. The boundary curve is shown in FIG. 2. Values τ included in the region on and below the boundary curve (i.e., $\tau \leqq -0.0006T^3+0.0288T^2-0.4668T+26.8$, where T represents an ambient temperature (° C.)) are preferred.

Now, the dependency of a measured time constant τ of the cold cathode fluorescent tube on an ambient temperature is considered. Time dependency I(t) of the rise of luminance of the cold cathode fluorescent tube is given by the following expression (4):

$$I(t) = A \cdot \{1 - \exp(-t/\eta \cdot C \cdot R)\} + B \cdot t \quad (4)$$

$$\eta = \tau / C \cdot R$$

where I(t) represents luminance (cd/m$^2$) of the cold cathode fluorescent tube at time t; A represents saturation luminance (cd/m$^2$) at an ambient temperature upon start-up; η is a coefficient indicating the relation between the above-mentioned time constants τ and τs, ηh indicating the present invention, whereas ηj indicating the conventional example; and B represents a coefficient (cd/m$^2$sec) of the speed at which the luminance rises. The result obtained for the above-mentioned respective cold cathode fluorescent tubes of the present invention and the conventional example will be shown in the following Table 6.

TABLE 6

| Ambient temperature (°C.) | Present invention db = 0.26 ηh | Conventional example db = 0.30 ηj |
|---|---|---|
| −20 | | |
| −10 | 3.3 | 3.2 |
| 0 | 2.4 | 2.9 |
| 25 | 2.0 | 2.3 |

As can be seen from Table 6, a coefficient η also changes according to temperature.

Next, the dependency of a pre-exponential factor A in the above expression (4) on temperature is considered. The pre-exponential factor A is given by the following expression (5), and activation energy ΔE was obtained.

$$A=A0\cdot\exp(-\Delta E/kb\cdot T) \quad (5)$$

In the above expression (5), A0 represents a pre-exponential factor of saturation relative luminance, ΔE represents activation energy (kcal/mol), kb represents a Boltzmann's constant, and T represents an ambient temperature (° C.) upon start-up of the cold cathode fluorescent tube.

Figure 3:
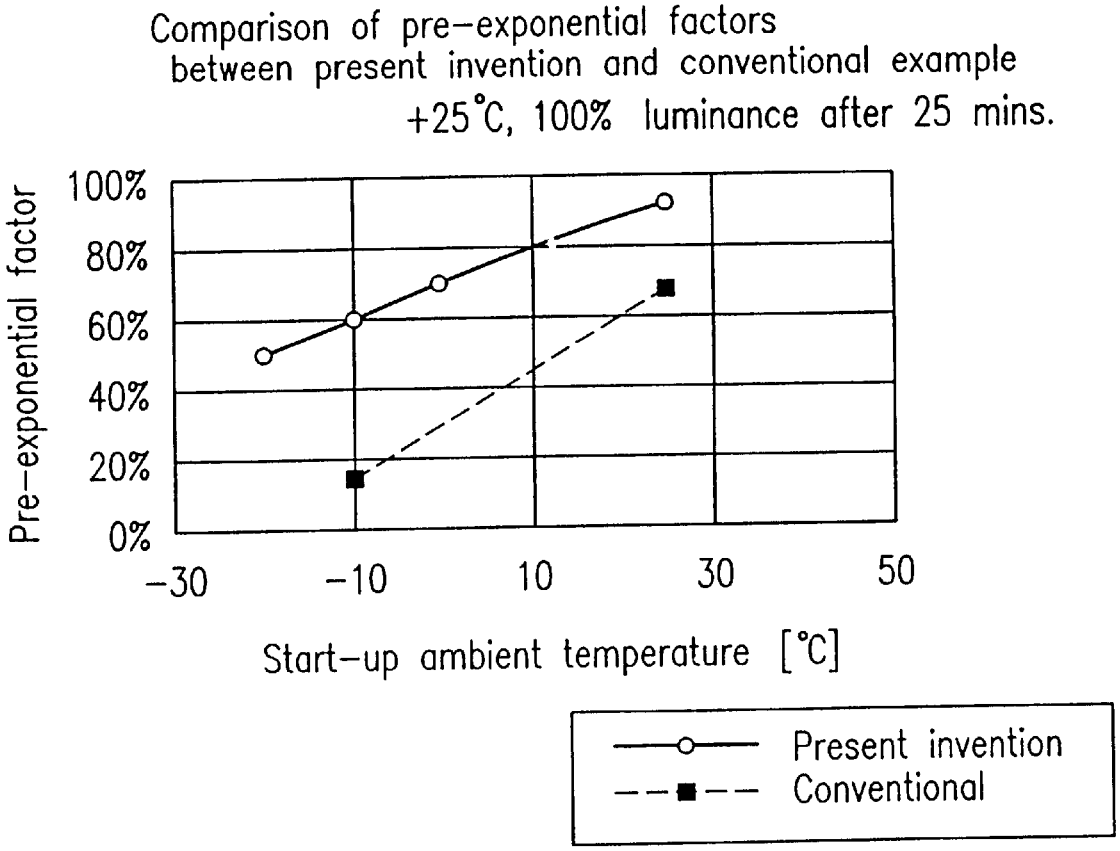
FIG. 3 is a graph showing dependency of a pre-exponential factor of a luminance rising characteristic of the first embodiment of the present invention and a conventional example on an ambient temperature upon start-up.
Figure 4:
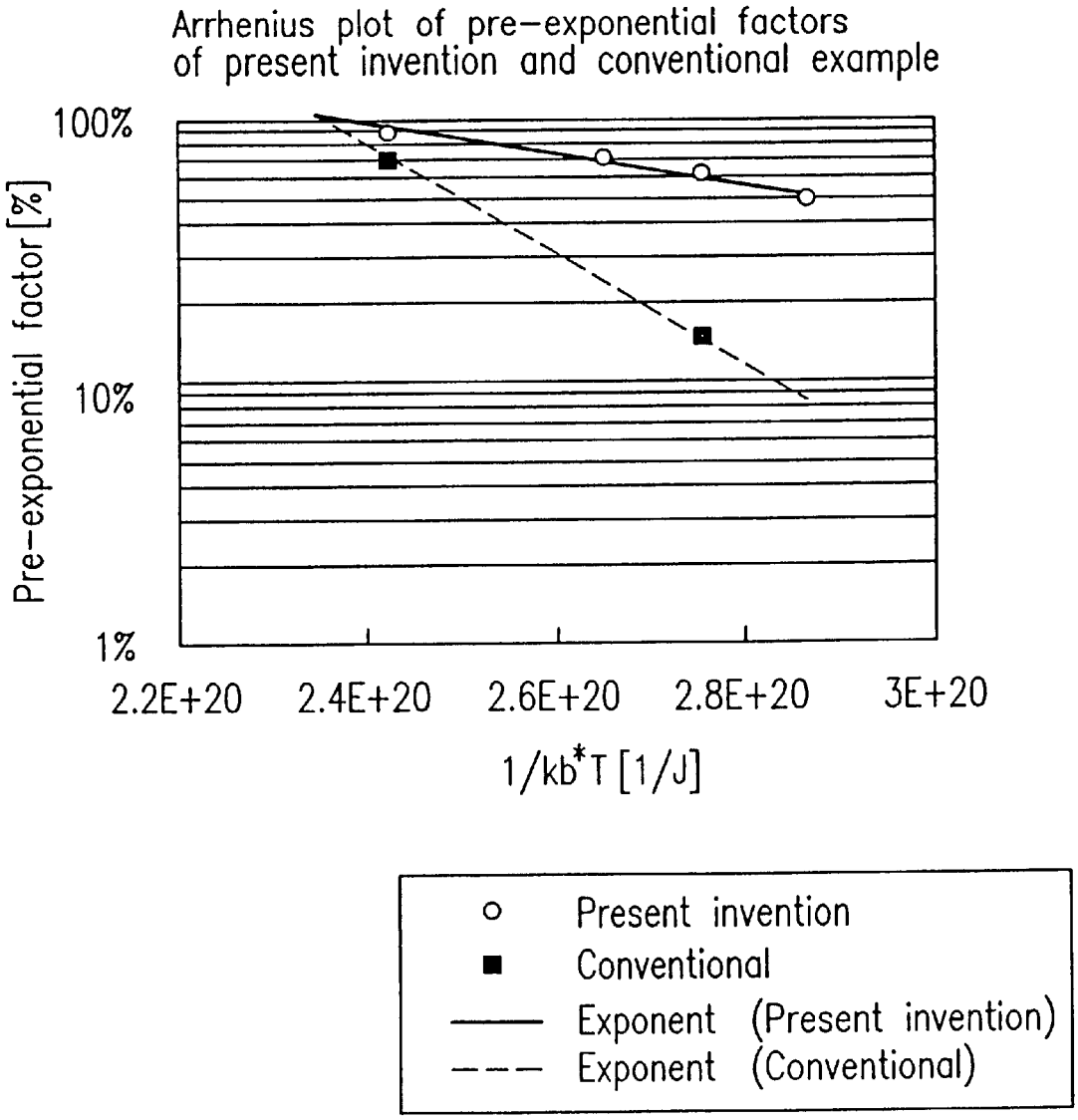
FIG. 4 is an Arrhenius plot showing dependency of a pre-exponential factor of a luminance rising characteristic of the first embodiment of the present invention and a conventional example on an ambient temperature upon start-up.

The result of experiment, an Arrhenius plot, and activation energy ΔE obtained therefrom are shown in FIGS. 3 and 4 and the following Tables 7 and 8. Note that values in Tables 7 and 8 are indicated as a percentage with respect to A0.

TABLE 7

| T(°C.) | Present invention Ah | Conventional example Aj |
|---|---|---|
| −20 | 50% | |
| −10 | 61% | 14% |
| 0 | 71% | |
| 25 | 92% | 68% |

TABLE 8

| | Present invention | Conventional example |
|---|---|---|
| ΔE(kcal/mol) | 2.0 | 7.0 |

As can be seen from the result shown in the above Table 7, the activation energy of the cold cathode fluorescent tube of the present invention is very small as compared to the cold cathode fluorescent tube of the conventional example, and therefore, the cold cathode fluorescent tube of the present invention has a stable thermal characteristic over a broad range of temperatures. In various respects, the activation energy of the cold cathode fluorescent tube used preferably in the present invention is preferably about 3.0 kcal/mol or less at an ambient temperature in the range from −10° C. to +25° C. In addition, the pre-exponential factor A is preferably A≧0.92T+60 at a temperature in the range from −10° C. to +25° C.

Figure 5:
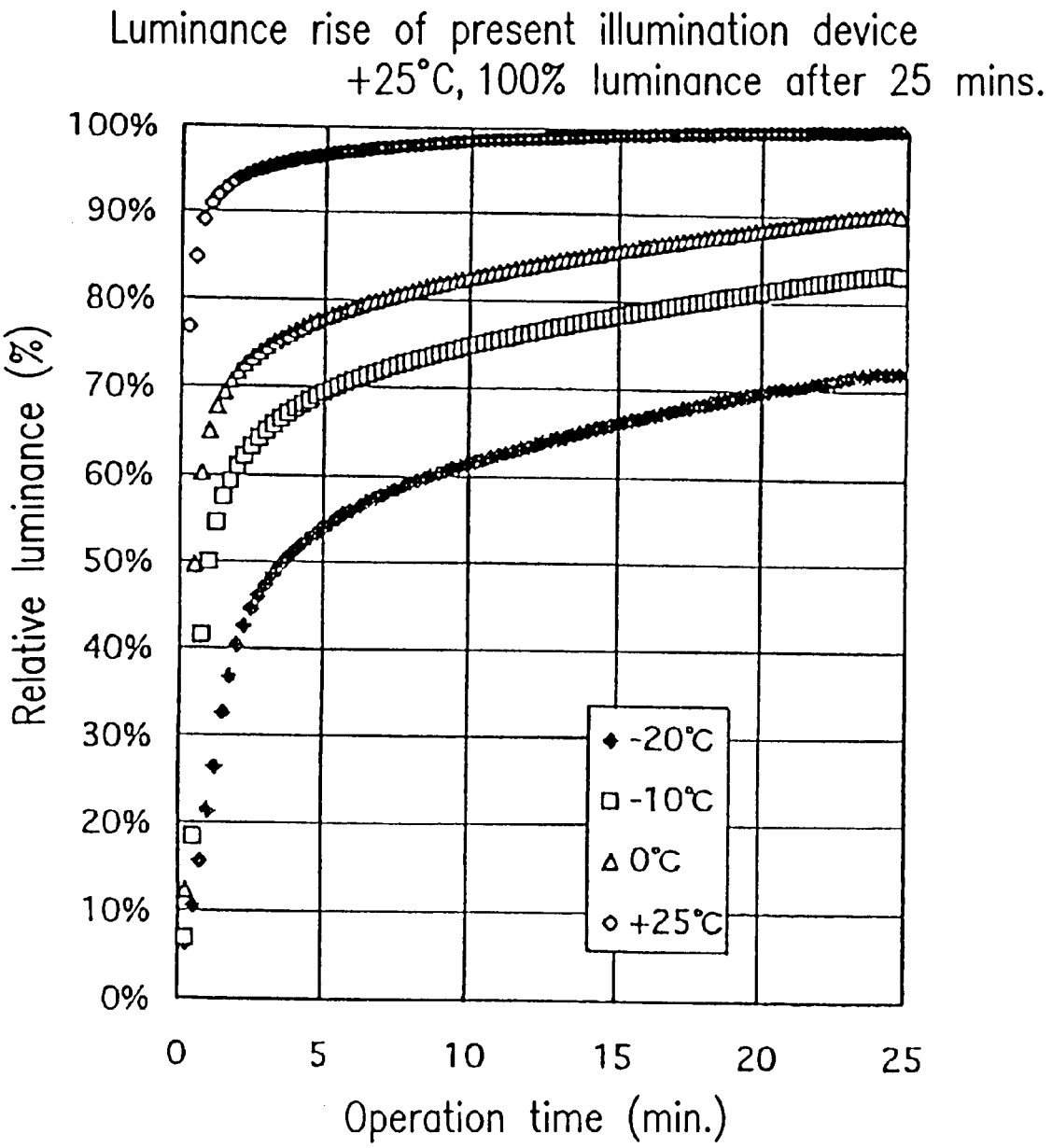
FIG. 5 is a graph showing a luminance rising characteristic of a cold cathode fluorescent tube according to the first embodiment of the present invention.
Figure 6:
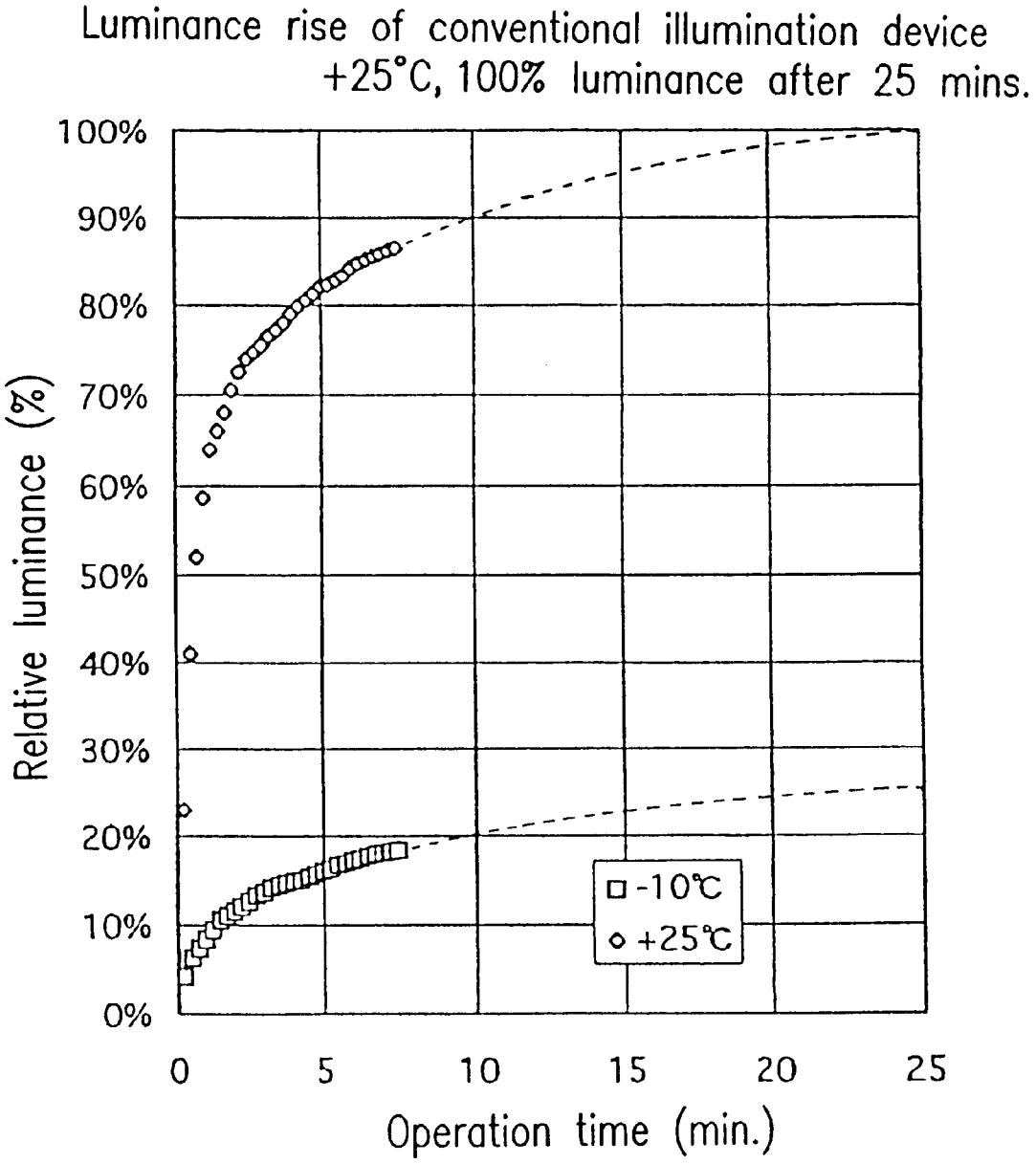
FIG. 6 PRIOR ART
FIG. 6 is a graph showing a luminance rising characteristic of a conventional cold cathode fluorescent tube.

The respective luminance rising characteristics of the cold cathode fluorescent tubes of the present invention and the conventional example were measured at various ambient temperatures. The result of the measurement is shown in FIGS. 5 and 6. As can be seen from FIGS. 5 and 6, the luminance rising characteristic of the illumination device of the present invention is much superior to that of the illumination device of the conventional example.

(Cold Cathode Fluorescent Tube with Large Heat Generation)

An illumination device using a cold cathode fluorescent tube generating a larger amount of heat than the conventional cold cathode fluorescent tube would solve the conventional problem of an insufficient luminance rise at a low temperature. In the case where the cold cathode fluorescent tube generates a larger amount of heat, mercury within the cold cathode fluorescent tube is heated, whereby the amount of mercury vapor will be significantly increased. As a result, luminance of the illumination device will be increased. In general, there are two method for increasing the amount of heat generation. The first method is to use a higher gas pressure in the cold cathode fluorescent tube than that in the conventional example. The second method is to increase a ratio of an argon gas in a gas filling the cold cathode fluorescent tube.

In the case where a gas pressure of the cold cathode fluorescent tube is increased according to the above-mentioned first method, the amount of heat generation by the cold cathode fluorescent tube is increased. The reason for this is as follows. When a gas pressure in the cold cathode fluorescent tube is increased, a mean free path for ionized atoms traveling within the cold cathode fluorescent tube is reduced, and therefore, the number of collisions between the atoms is larger than that in the conventional cold cathode fluorescent tube. As a result, the amount of heat generation is increased. In the present invention, the gas pressure is preferably about 100 Torr or more, and more preferably, about 120 Torr or more.

In the case where a ratio of an argon gas in a gas filling the cold cathode fluorescent tube is increased according to the above-mentioned second method, the amount of heat generation by the cold cathode fluorescent tube is increased. The reason for this is as follows. Usually, the cold cathode fluorescent tube is filled with a mixed gas of neon and argon. Since an argon gas is about twice as heavy as a neon gas in terms of an atomic weight, the amount of heat generated upon collision of an argon gas is larger than that generated upon collision of an neon gas. Accordingly, the amount of heat generation by the cold cathode fluorescent tube can be increased by increasing the ratio of an argon gas.

Figure 7:
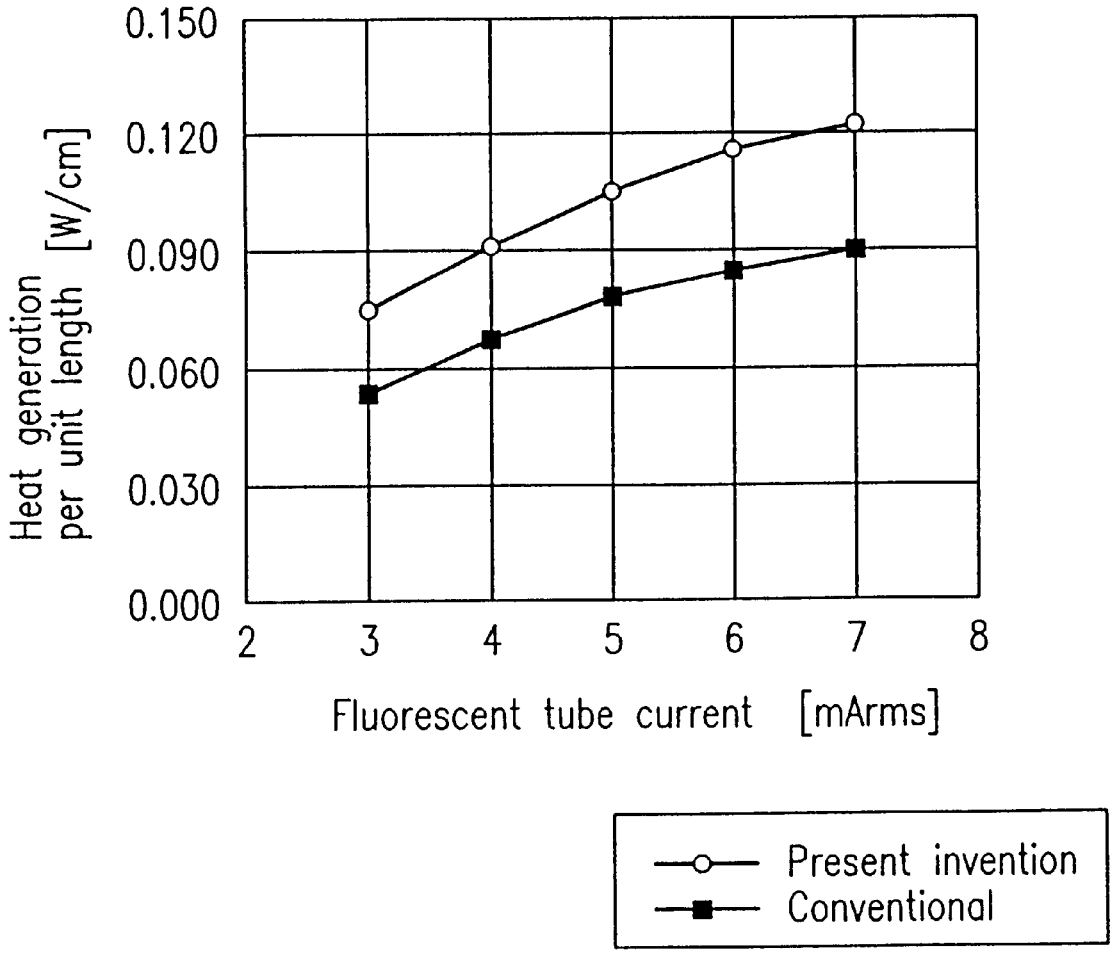
FIG. 7 is a graph showing dependency of the amount of heat generation per unit length of respective cold cathode fluorescent tubes of the first embodiment of the present invention and a conventional example on a current applied to the cold cathode fluorescent tube.

In the present invention, the argon/neon ratio is set to about 40/60 or more so as to increase the amount of heat generated by the cold cathode fluorescent tube. In the present invention as shown in FIGS. 7 thorough 10, a gas pressure of the cold cathode fluorescent tube is 120 Torr, and the argon/neon ratio is about 40/60. Meanwhile, in a conventional example, a gas pressure of the cold cathode fluorescent tube is 60 Torr and the argon/neon ratio is 5/95.

Figure 8:
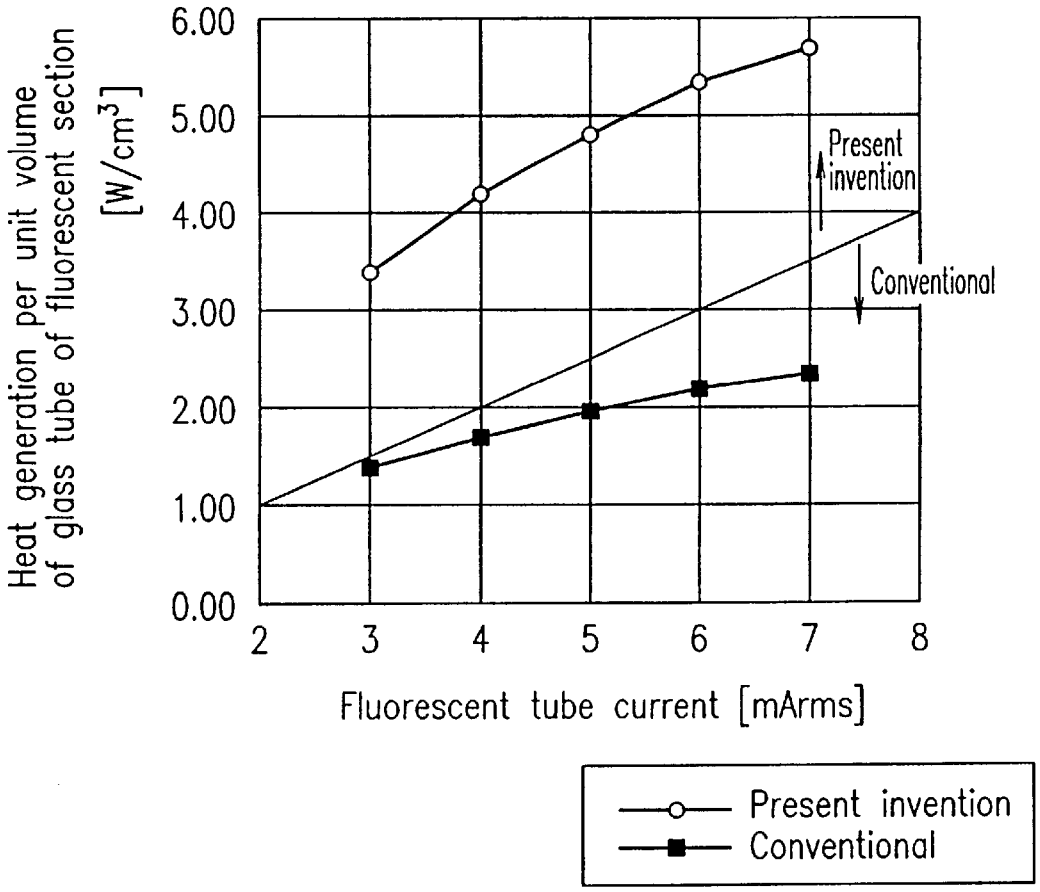
FIG. 8 is a graph showing dependency of the amount of heat generation per unit volume of respective cold cathode fluorescent tubes of the first embodiment of the present invention and a conventional example on a current applied to the cold cathode fluorescent tube.

As can be seen from FIGS. 7 and 8, the amount of heat generated by the cold cathode fluorescent tube (per unit length and per unit volume) is larger than that generated by the conventional cold cathode fluorescent tube. Preferably, the cold cathode fluorescent tube used preferably in the present invention satisfies the relation Wv/Iccft≧0.5, where Wv(W) represents the amount of heat generation per unit volume and Iccft (mA) represents a current across the cold cathode fluorescent tube. This corresponds to a region on and above the straight line in FIG. 8.

Figure 9:
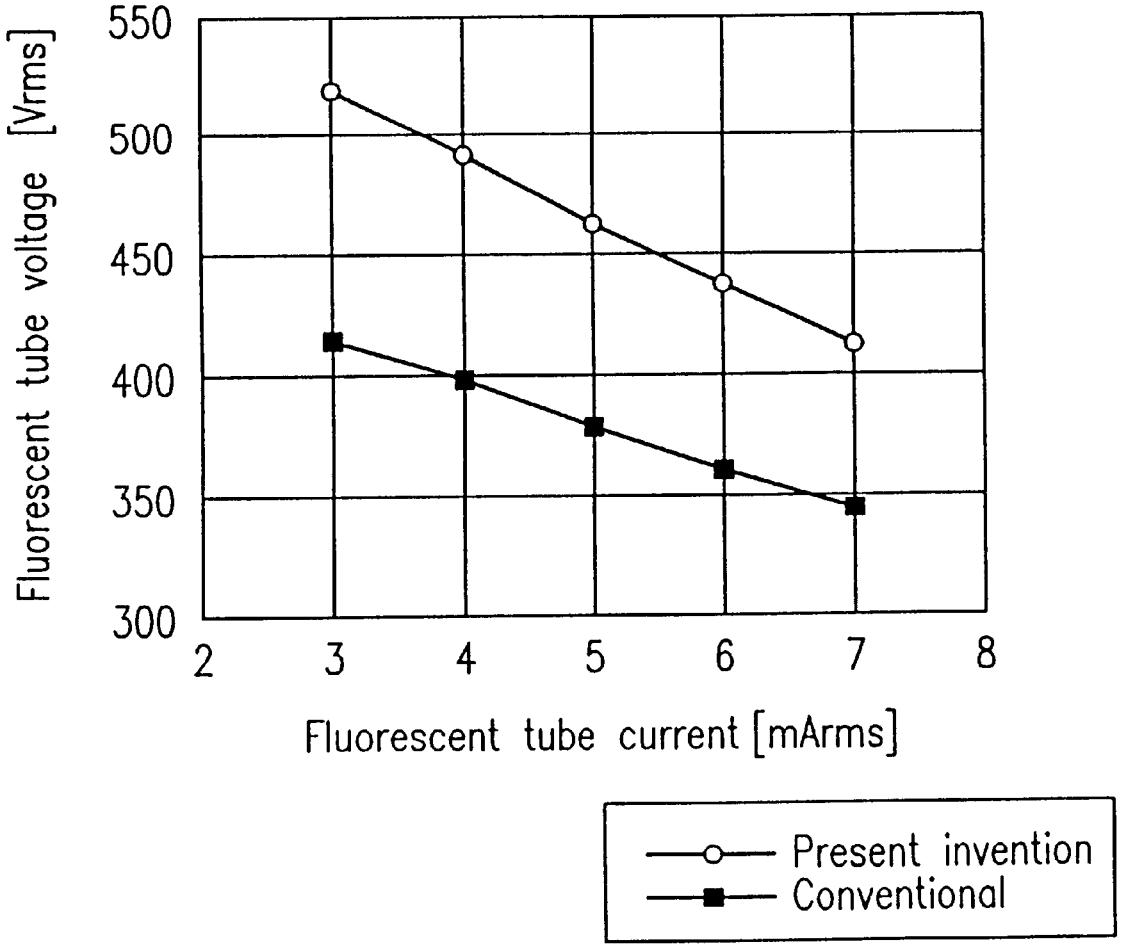
FIG. 9 is a graph showing a relation between a current and a voltage applied to respective cold cathode fluorescent tubes of the first embodiment of the present invention and a conventional example.
Figure 10:
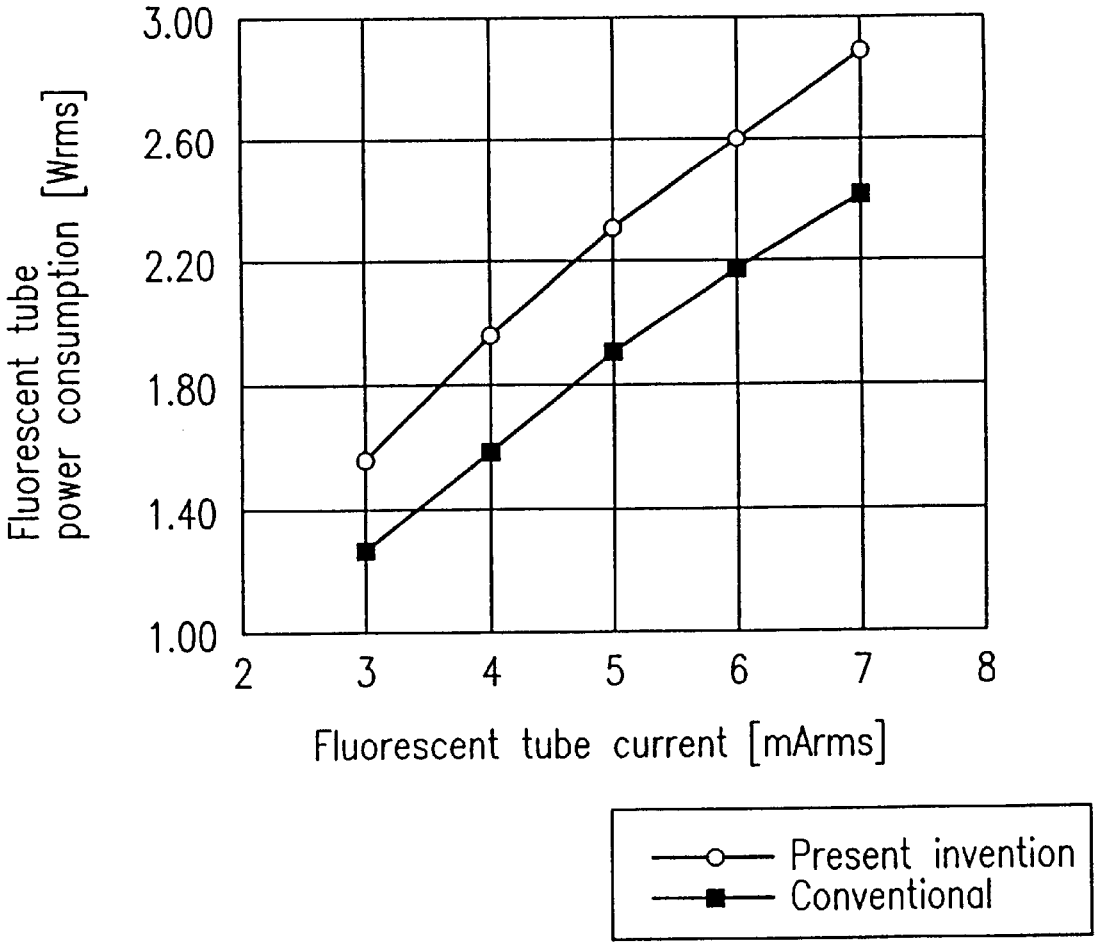
FIG. 10 is a graph showing a relation between a current applied to a cold cathode fluorescent tube and power consumption thereof in the first embodiment of the present invention and a conventional example.

FIG. 9 shows a relation between a current and a voltage across the cold cathode fluorescent tube for the respective cold cathode fluorescent tubes of the present invention and the conventional example. As can be seen from FIG. 9, a voltage applied to the cold cathode fluorescent tube of the present invention is higher than that in the conventional example. FIG. 10 shows power consumption of the respective cold cathode fluorescent tubes of the present invention and the conventional example. As can be seen from FIG. 10, the power consumption of the cold cathode fluorescent tube of the present invention is larger than that of the conventional example. Thus, the cold cathode fluorescent tube consumes a large amount of power at a positive column. Therefore, it can be found that the amount of heat generated by a gas at the fluorescent section of the cold cathode fluorescent tube of the present invention is larger than that in the case of the conventional example.

(Method for Controlling a Cold Cathode Fluorescent Tube)

A method for controlling a cold cathode fluorescent tube will now be described. In the following description, an example in which the illumination device according to the present invention is applied to an on-vehicle display device is considered. As described above, the cold cathode fluorescent tube according to the present invention has an excellent luminance rising characteristic. Therefore, it is not necessary to apply a boost current upon activation at a low temperature. However, it should be understood that the luminance rising characteristic at a low temperature can be improved by applying a boost current upon activation at a low temperature. Hereinafter, a method for controlling the cold cathode fluorescent tube wherein a boost current is also applied upon activation will be described.

An operation mode is selected by, for example, an ambient temperature of the on-vehicle display device. In the case where the ambient temperature is significantly lower than a temperature range (between about 15° C. to about 30° C.) controlled by air conditioning of the vehicle (for example, in the case where the ambient temperature is near −30° C.), a current higher than a rated current (for example, 4 mArms) (for example, a current of 5 mArms) is applied to the cold cathode fluorescent tube for a short time from activation. In the case where the ambient temperature is equal to or higher than the above-mentioned temperature range, it is sufficient to apply the rated current to the cold cathode fluorescent tube from the activation.

Figure 11:
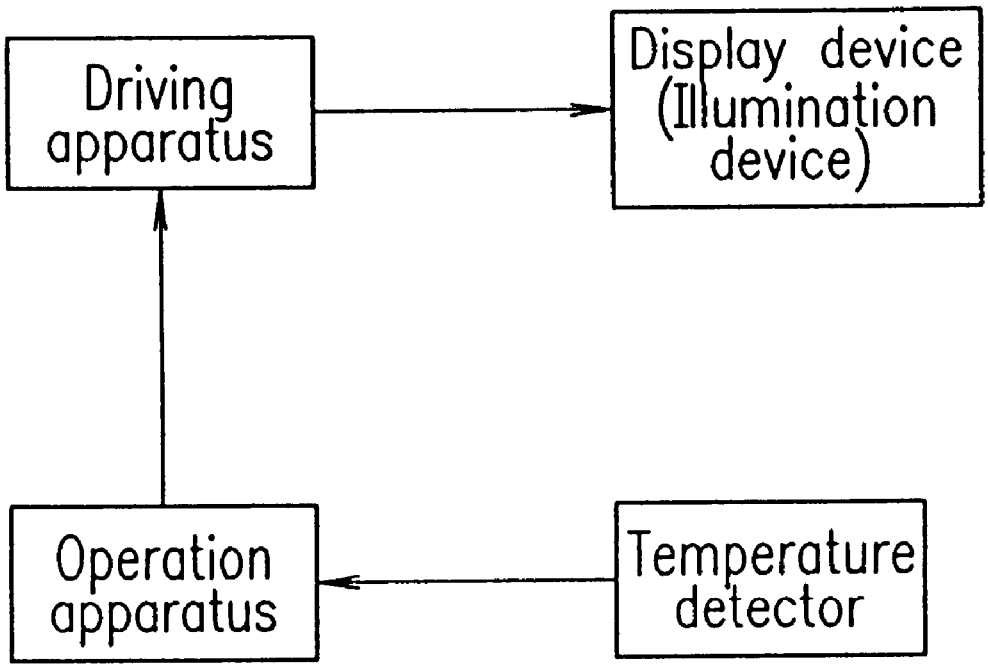
FIG. 11 is a block diagram showing a control circuit system of the illumination device of the first embodiment of the present invention.
Figure 12:
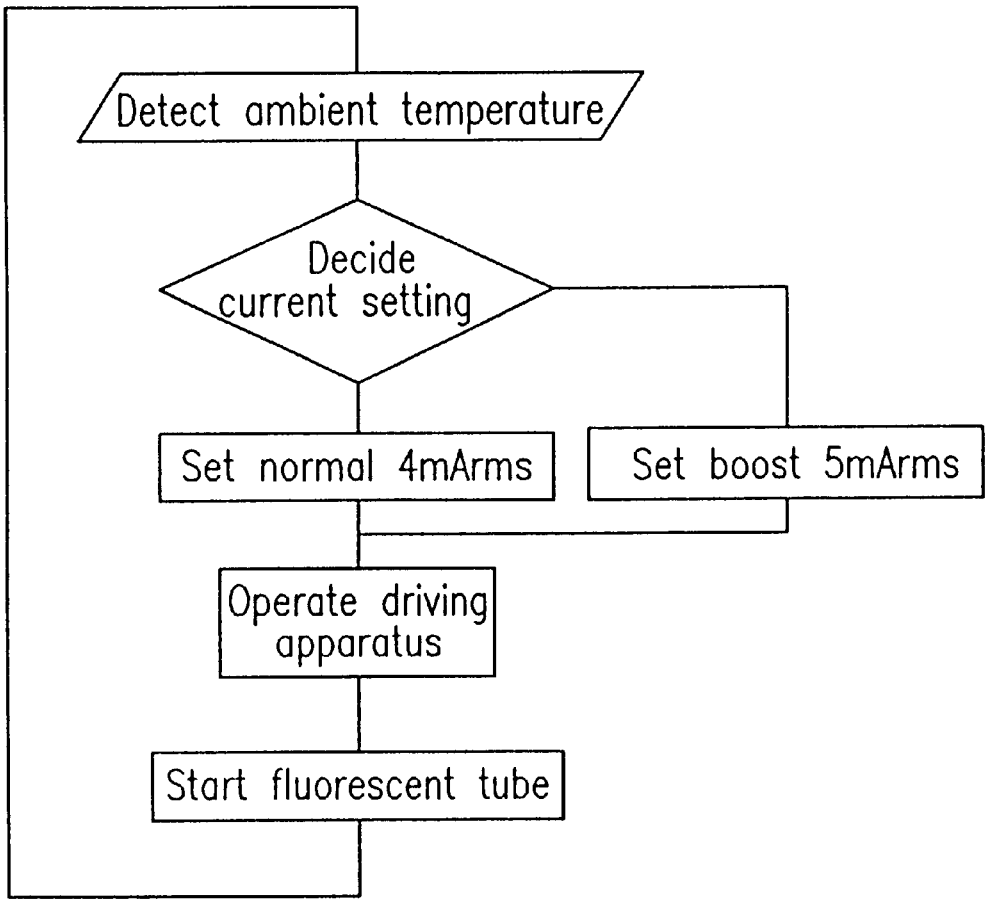
FIG. 12 is a flow chart illustrating a method for controlling the illumination device of the first embodiment of the present invention.

For example, such selection of the operation mode is carried out according to the flow chart shown in FIG. 12 by a control circuit system shown in FIG. 11. More specifically, a temperature detector provided in the vicinity of the display device measures an ambient temperature. Then, an operation apparatus receives the ambient temperature, determines current setting for the cold cathode fluorescent tube, and thereafter applies a signal to a driving apparatus so as to apply a rated current or a boost current. In response to the signal, the driving apparatus starts operating to apply a prescribed current for the cold cathode fluorescent tube to the illumination device.

(Polarization Selective Reflection Sheet)

In order to improve luminance as a system, a polarization direction of light emitted from the illumination device can be changed to an optimal polarization direction for the display device to increase efficiency of utilizing light. In general, there are two methods for realizing this.

The first method is to use a polarization selective reflection sheet for reflecting an S-polarized light component while transmitting a P-polarized light component. A structure of such a polarization selective reflection sheet is disclosed in detail in Japanese Laid-Open Publication No. 6-51399.

The second method is to use a $\lambda/4$ plate and a polarization selective reflection sheet for reflecting a left circularly-polarized light component while transmitting a right circularly-polarized light component. Respective structures of such a polarization selective reflection sheet and a $\lambda/4$ plate are disclosed in detail in the U.S. Pat. No. 5,506,704.

These sheets would effectively contribute to an increase in luminance particularly in the case where the display device provided on the illumination device is a device utilizing polarized light (for example, a liquid crystal display device).

EXAMPLES

Example 1

Figure 13A:
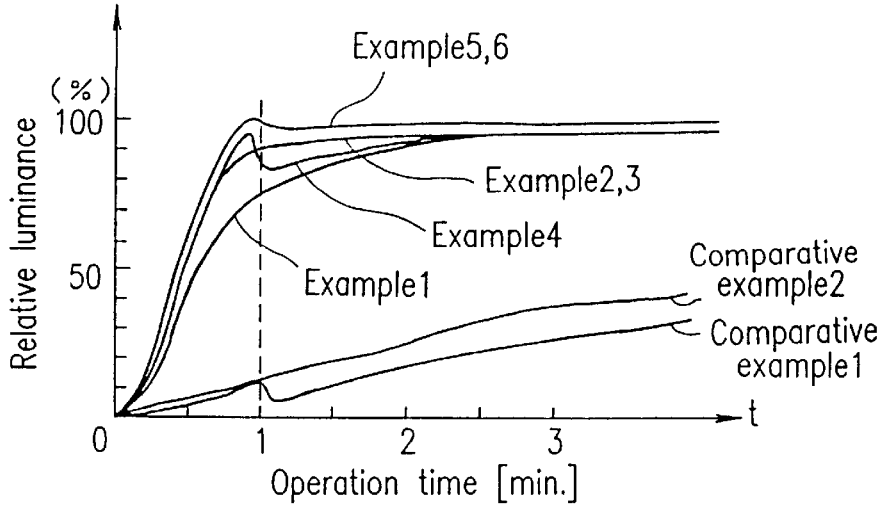
FIG. 13A is a graph showing luminance rising characteristics of respective cold cathode fluorescent tubes of examples of the first embodiment of the present invention and comparative examples.
Figure 13B:
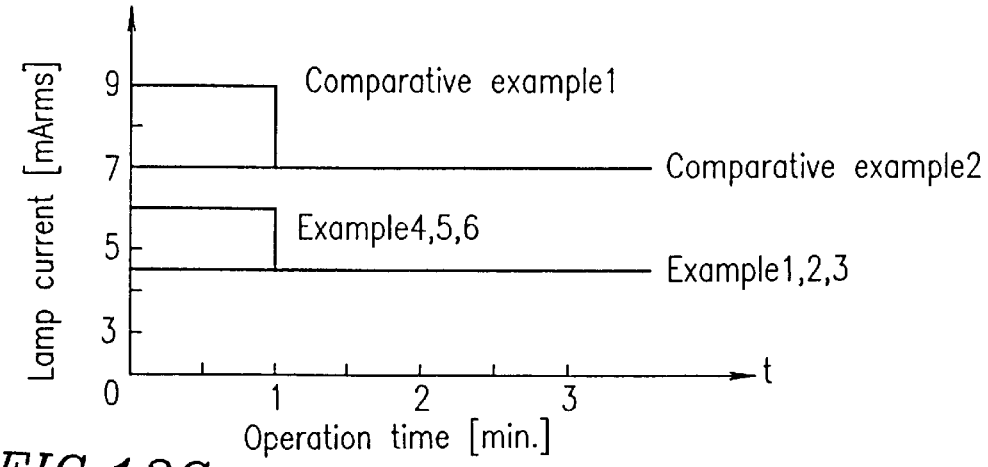
FIG. 13B is a graph showing a current applied to each of the cold cathode fluorescent tubes of the examples and the comparative examples.

A luminance rising characteristic at an ambient temperature of about −30° C. is shown in FIG. 13A as an example 1. In the example 1, an illumination device has the same structure as that shown in FIG. 1B except without using a polarization selective reflection sheet 6, and includes a display element which utilizes polarized light for display. In this case, a constant current of about 4.5 mArms was applied to a cold cathode fluorescent tube with a small heat capacity and large heat generation, as shown in the following Table 9 and FIG. 13B. A current applied to respective cold cathode fluorescent tubes of examples and comparative examples, and presence/absence of a polarization selective reflection sheet in the respective cold cathode fluorescent tubes, are shown in the following Table 9.

Example 2

A luminance rising characteristic at an ambient temperature of about −30° C. is shown in FIG. 13A as an example 2. In the example 2, an illumination device has the same structure as that of the example 1 except for using a polarization selective reflection sheet 6 utilizing linearly polarized light, and including a display element which utilizes polarized light for display. In this case, a constant current of about 4.5 mArms was applied to a cold cathode fluorescent tube with a small heat capacity and large heat generation, as shown in the following Table 9 and FIG. 13B.

Example 3

A luminance rising characteristic at an ambient temperature of about −30° C. is shown in FIG. 13A as an example 3. In the example 3, an illumination device has the same structure as that of the example 2 except for using a polarization selective reflection sheet which utilizes circularly polarized light instead of the polarization selective reflection sheet 6, and including a display element which utilizes polarized light for display. In this case, a constant current of about 4.5 mArms was applied to a cold cathode fluorescent tube with a small heat capacity and large heat generation, as shown in the following Table 9 and FIG. 13B.

Example 4

A luminance rising characteristic at an ambient temperature of about −30° C. is shown in FIG. 13A as an example 4. In the example 4, a slightly larger current of about 6.0 mArms was applied to the cold cathode fluorescent tube of the illumination device of the example 1 for a period of less than about 1 minute from the start-up, and a reduced current of about 4.5 mArms was applied thereafter, as shown in the following Table 9 and FIG. 13B.

Example 5

A luminance rising characteristic at an ambient temperature of about −30° C. is shown in FIG. 13A as an example 5. In the example 5, a slightly larger current of about 6.0 mArms was applied to the cold cathode fluorescent tube of the illumination device of the example 2 for a period of less than about 1 minute from the start-up, and a reduced current of about 4.5 mArms was applied thereafter, as shown in the following Table 9 and FIG. 13B.

Example 6

A luminance rising characteristic at an ambient temperature of about −30° C. is shown in FIG. 13A as an example 6. In the example 6, a slightly larger current of about 6.0 mArms was applied to the cold cathode fluorescent tube of the illumination device of the example 3 for a period of less than about 1 minute from the start-up, and a reduced current of about 4.5 mArms was applied thereafter, as shown in the following Table 9 and FIG. 13B.

Comparative Example 1

A luminance rising characteristic at an ambient temperature of about −30° C. is shown in FIG. 13A as a comparative example 1. In the comparative example 1, an illumination device has the same structure as that shown in FIGS. 1A and 1B. However, the illumination device of the comparative example 1 does not use the polarization selective reflection sheet 6 of FIG. 1B, and includes a conventional cold cathode fluorescent tube. In this case, a current of about 9.0 mArms, which is larger than a rated current of about 7.0 mArms, was applied to the cold cathode fluorescent tube for about 1 minute from the start-up, and a reduced current of about 4.5 mArms was applied thereafter, as shown in the following Table 9 and FIG. 13B.

Comparative Example 2

Figure 13C:
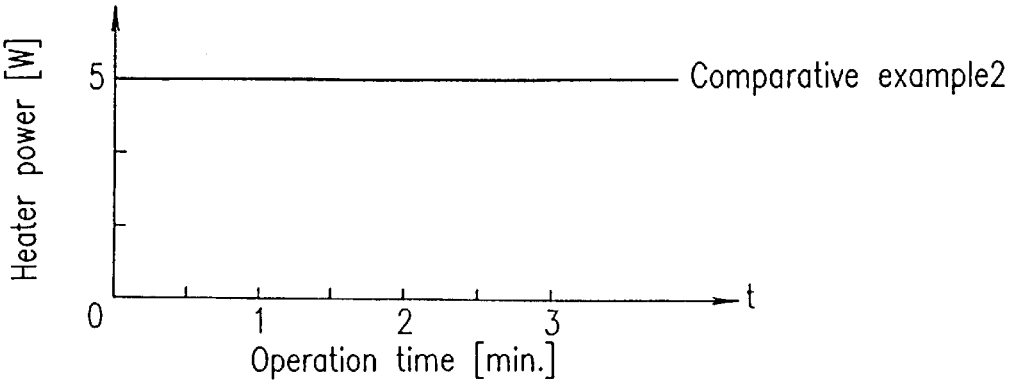
FIG. 13C is a graph showing power supplied to a heater used in the comparative example 2.

A luminance rising characteristic at an ambient temperature of about −30° C. is shown in FIG. 13A as a comparative example 2. In the comparative example 2, an illumination device has the same structure as that shown in FIGS. 1A and 1B. In the comparative example 2, however, the illumination device does not use the polarization selective reflection sheet 6 of FIG. 1B, a conventional cold cathode fluorescent tube is provided, and a heater is provided directly to the cold cathode fluorescent tube. In this case, a constant current of about 7.0 mArms was applied to the cold cathode fluorescent tube and power of about 5W was supplied to the heater, as shown in the following Table 9 and FIGS. 13B and 13C.

As can be seen from FIG. 13A, each of the above-described examples of the present invention has a significantly improved luminance rising characteristic over the conventional examples. In addition, even in the case where a boost current is applied in the above-described examples 4 through 6, luminance variation is within about −25%, achieving a highly stable luminance rising characteristic. The term "luminance variation" herein indicates a rate at which the luminance is reduced upon switching from a boost current to a rated current. This luminance variation can be given by the expression $\{(Bn/Bb)-1\} \cdot 100$ (%) where Bn represents luminance obtained upon switching from a boost current to a rated current, and Bb represents luminance obtained upon completion of a boost current.

TABLE 9

| | lamp current after start-up (fluorescent tube current) (mArms) | | presence/absence of selective polarized light reflection sheet | |
|---|---|---|---|---|
| | less than 1 min. | from 1 min. | linear polarization | circular polarization |
| Example 1 | 4.5 | 4.5 | none | none |
| Example 2 | 4.5 | 4.5 | present | none |
| Example 3 | 4.5 | 4.5 | none | present |
| Example 4 | 6.0 | 4.5 | none | none |
| Example 5 | 6.0 | 4.5 | present | none |
| Example 6 | 6.0 | 4.5 | none | present |
| Comparative example 1 | 9.0 | 7.0 | — | — |
| Comparative example 2 | 7.0 | 7.0 | — | — |

As has been described in the above examples, a display device which uses an illumination device including a cold cathode fluorescent tube with a small heat capacity and large heat generation and a polarization selective reflection sheet as described in the first embodiment of the present invention has a superior luminance rise at a low temperature to that of an illumination device including a heater. Thus, such an illumination device of the present invention can solve the problem of an insufficient luminance rise at a low temperature. Such an illumination device of the present invention is also advantageous in terms of safety because a heater is not used. In addition, no circuit associated with the heater is required. Therefore, the manufacturing cost can be significantly reduced. Moreover, the cost for attaching the heater is not required. In the case where a heater is used to heat the cold cathode fluorescent tube, heat energy is applied indirectly to the cold cathode fluorescent tube, and therefore, the heat is conducted and radiated to constituent members of the illumination device other than the cold cathode fluorescent tube. As a result, the illumination device is heated excessively. However, in the case where the cold cathode fluorescent tube with a small heat capacity and large heat generation is used, heat energy is applied directly to the inside of the cold cathode fluorescent tube which is to be heated, without using a heater. As a result, power consumption can be reduced. Moreover, the cold cathode fluorescent tube is thermally isolated by air. Therefore, there is also an advantage that the illumination device will not be heated excessively. In addition, as opposed to the illumination device using a heater, luminance is saturated soon after the start-up in the illumination device using a cold cathode fluorescent tube. Therefore, luminance instability is small upon switching of a current. Moreover, as compared to the conventional case where a large current is applied to the cold cathode fluorescent tube for a while after start-up without using a heater, a current applied to the cold cathode fluorescent tube of the present invention is smaller. Therefore, according to the present invention, power consumption can be reduced as well as a life of the cold cathode fluorescent tube can be increased. In addition, a luminance rising characteristic at a low temperature, which is an essential objective of the present invention, is significantly improved over the above-mentioned case where a large current is applied to the cold cathode fluorescent tube for a while after the start-up. Embodiment 2

A second embodiment of the present invention will now be described.

Figure 1C:
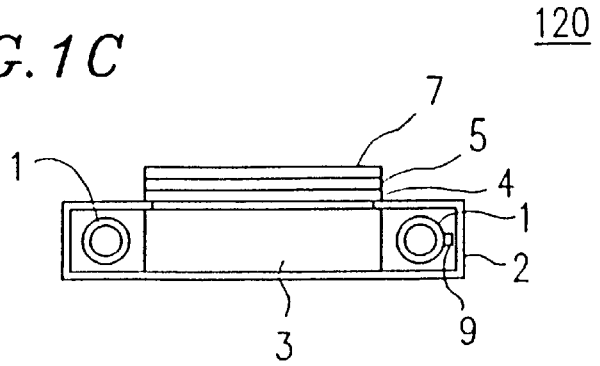
FIG. 1C is a cross sectional view taken along the line 1B—1B of FIG. 1A, showing an illumination device 120 included in a display device 101 of a second embodiment of the present invention.

An illumination device 120 shown in FIG. 1C further includes a temperature sensor 9 thermally coupled to a cold cathode fluorescent tube 1, in addition to the components of the illumination device 110 shown in FIG. 1B. The temperature sensor 9 includes a thermistor and is thermally coupled only to one cold cathode fluorescent tube 1. The phrase "thermally coupled" as used herein means that the temperature sensor 9 is provided at such a position that the temperature sensor 9 and the cold cathode fluorescent tube 1 are approximately in thermal equilibrium. More specifically, in the second embodiment, the temperature sensor 9 is provided at a portion of a wall of the cold cathode fluorescent tube 1. Note that like elements are denoted with like reference numerals in FIGS. 1B and 1C.

Although the temperature sensor 9 may be provided at any position of the walls of the cold cathode fluorescent tube 1, the temperature sensor 9 is provided at a wall of the cold cathode fluorescent tube 1, facing outward within the display device 101 and the illumination device 120, as shown in FIG. 1C. Such a position is selected because luminous flux from the cold cathode fluorescent tube 1 can be efficiently utilized. The temperature sensor 9 may be provided at a position where provision of the temperature sensor 9 is easily accomplished.

According to the illumination device 120 having the above-described structure, the cold cathode fluorescent tube 1 is affected by an ambient temperature. However, when constant power is supplied to the cold cathode fluorescent tube 1 and the amount of heat generated by the cold cathode fluorescent tube 1 itself is in thermal equilibrium with heat losses due to radiation, heat conduction and the like, a parameter which determines brightness of the cold cathode fluorescent tube 1 is determined by a vapor pressure of mercury filling the cold cathode fluorescent tube 1. Therefore, the brightness is a function of an equilibrium temperature (i.e., a temperature of the cold cathode fluorescent tube 1).

Thus, the illumination device of the present embodiment controls power supplied to the cold cathode fluorescent tube 1 according to a temperature sensed by the temperature sensor 9 so as to obtain intended brightness, that is, intended luminance at any ambient temperature.

Figure 14:
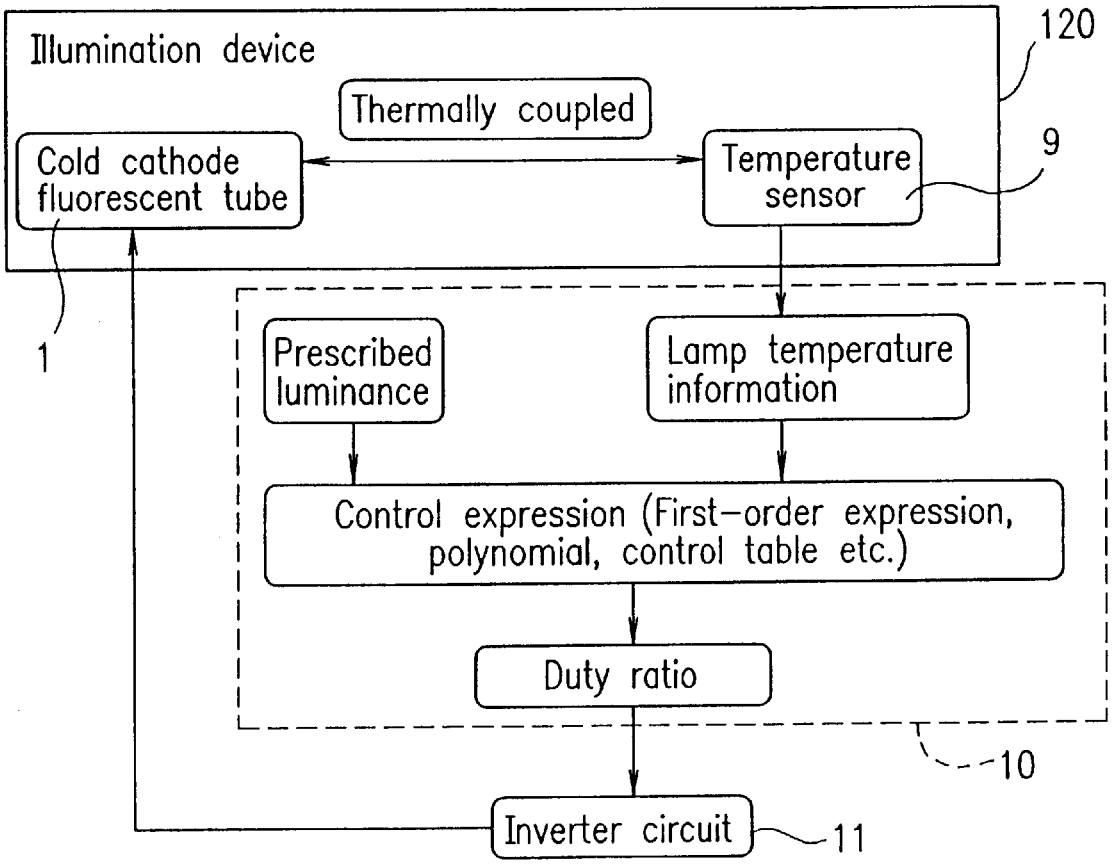
FIG. 14 is a block diagram illustrating how control is conducted in a second embodiment of the present invention.

This will be described more specifically with reference to FIG. 14. A control apparatus 10 reads a sensed-temperature signal supplied from the temperature sensor 9 at a prescribed sampling pitch to obtain lamp temperature information. Then, based on the lamp temperature information, prescribed-luminance information, and approximation expressions including an expression of the first order or a polynomial stored in a random access memory (RAM), a relation between a temperature of a wall of the cold cathode fluorescent tube 1 and luminance is obtained for each supplied power. Thus, supplied power for realizing this luminance (for example, a duty ratio) is obtained. As described above, in the case where power supplied to the cold cathode fluorescent tube is constant (or a constant current applied to the cold cathode fluorescent tube is constant), luminance is a function of a temperature of a wall of the cold cathode fluorescent tube 1, that is, a function of a temperature sensed by the temperature sensor 9 thermally coupled to the cold cathode fluorescent tube 1. Therefore, using an expression of the first order or a polynomial for approximation, power supplied to the cold cathode fluorescent tube 1, that is, a duty ratio for achieving intended luminance can be obtained. Then, based on the duty ratio, an inverter circuit 11 connected to each of the cold cathode fluorescent tubes 1 and 1 is driven, whereby intended luminance can be obtained at any ambient temperature.

For example, in the case where the polynomial is an expression of, for example, the sixth order, luminance BP at a panel plane of the liquid crystal display device 8 is given by the following expression (6) using a temperature TL of a wall of the cold cathode fluorescent tube 1.

$$BP=3\times10^{-8}TL^6-4\times10^{-7}TL^5+8\times10^{-5}TL^4+0.002TL^3-0.0006TL^2+0.101TL+29.883 \quad (6)$$

In the case where the expression of the first order is used for approximation, the luminance BP is given by the following expressions (7) through (9) according to a value of TL.

$$\text{For } TL<15:\ BP=0.625TL+38.5 \quad (7)$$

$$\text{For } 15\leqq TL\leqq 45:\ BP=10TL-150 \quad (8)$$

$$\text{For } 45<TL:\ BP=3TL+165 \quad (9)$$

Note that the coefficient in the above expressions (6) through (9) is determined by a heat capacity of the system, luminous flux efficiency of the system, and the like.

By using a cold cathode fluorescent tube with a small heat capacity and large heat generation in the illumination device of the second embodiment, control as described above can be conducted more desirably. As a result, light modulation can be carried out with higher accuracy. A heat capacity C is preferably about 0.06 Wsec/° C. or less, and more preferably, about 0.035 Wsec/° C. or less. The reason for this is as follows. The smaller a heat capacity of the cold cathode fluorescent tube 1 is, the more the heat energy generated or conducted within the cold cathode fluorescent tube can be utilized efficiently. As a result, the cold cathode fluorescent tube 1 can be heated faster. Moreover, the larger the amount of heat generated by the cold cathode fluorescent tube 1 is, the faster the cold cathode fluorescent tube 1 can be heated. Therefore, the difference between an actual temperature within the cold cathode fluorescent tube 1 and a temperature sensed by the temperature sensor 9 is reduced. As a result, a time lag between a temperature sensed by the temperature sensor 9 and an actual temperature of the cold cathode fluorescent tube 1 is reduced.

With reference to FIGS. 15 through 20, effects of the present embodiment will be described in the following in comparison with the conventional example.

Figure 15:
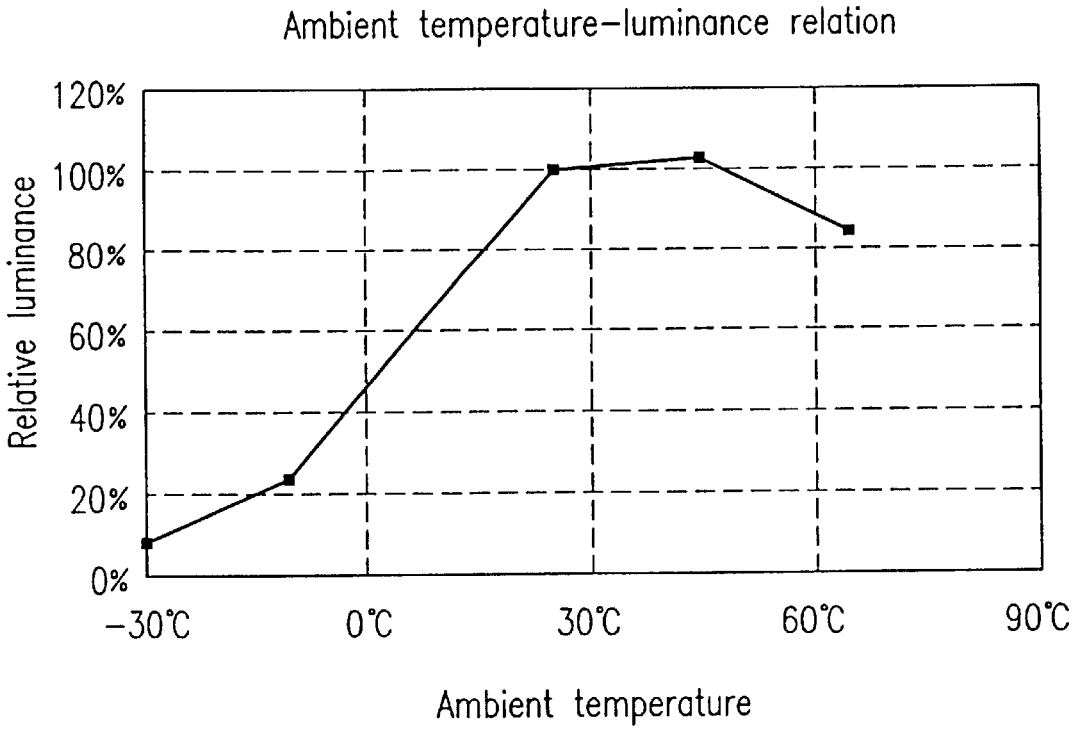
FIG. 15 PRIOR ART
FIG. 15 is a graph showing a relation between an ambient temperature and luminance (relative luminance) in an illumination device including a conventional cold cathode fluorescent tube.
Figure 16:
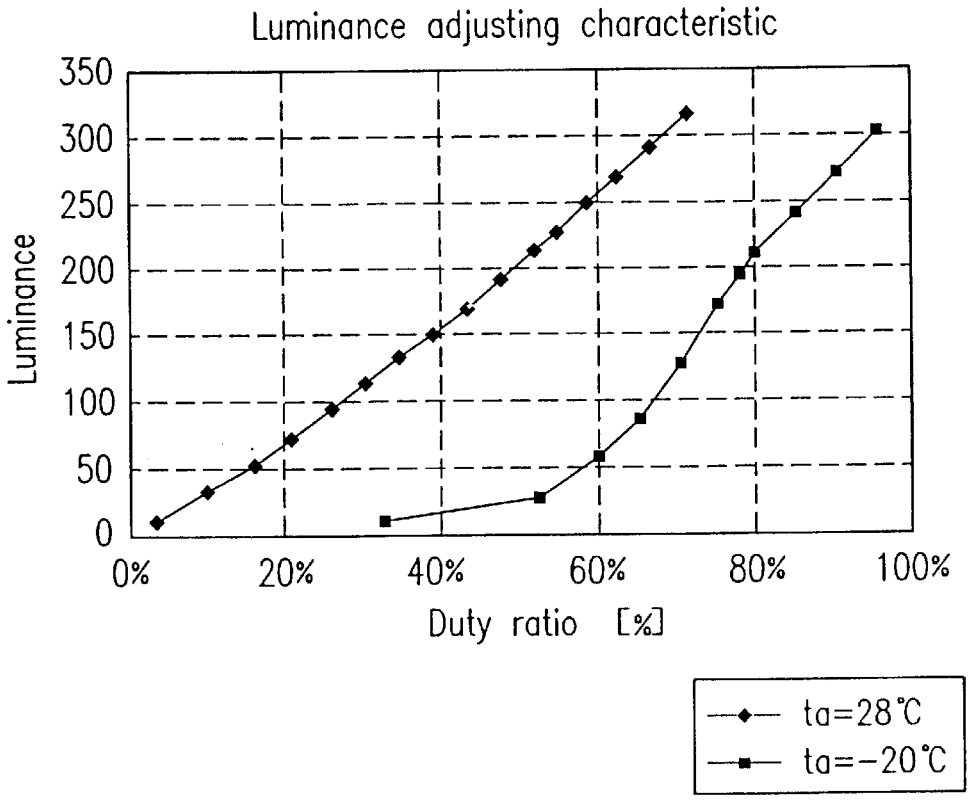
FIG. 16 PRIOR ART
FIG. 16 is a graph showing a result of light modulation for different ambient temperatures in an illumination device including a conventional cold cathode fluorescent tube.

As shown in FIG. 15, in the conventional illumination device using a cold cathode fluorescent tube as a light source, brightness (relative luminance) is affected by an environment (an ambient temperature). As a result, as shown in FIG. 16, intended luminance could not be obtained due to the influence of the ambient temperature in the conventional light modulation method (in which only a duty ratio is changed). In other words, luminance at an ambient temperature ta= about 28° C. is different from that at ta= about −20° C.

Figure 17:
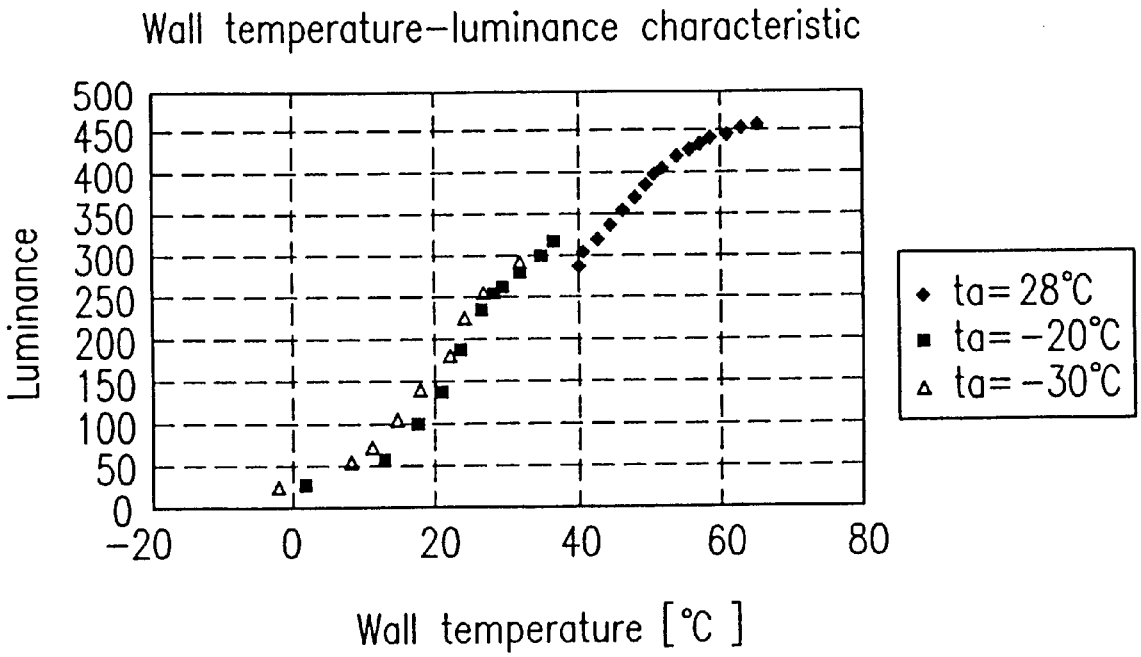
FIG. 17 is a graph showing a relation between luminance and a wall temperature of a cold cathode fluorescent tube in an illumination device according to the second embodiment.

On the other hand, according to the present embodiment, luminance is approximately proportional to a temperature of a wall of the cold cathode fluorescent tube 1 regardless of an ambient temperature ta (= about 28° C., −20° C., and −30° C.), as shown in FIG. 17. In other words, according to the present embodiment having the temperature sensor 9 thermally coupled to the cold cathode fluorescent tube 1, this relation between luminance and a temperature of the wall of the cold cathode fluorescent tube can be obtained at any ambient temperature.

Figure 18:
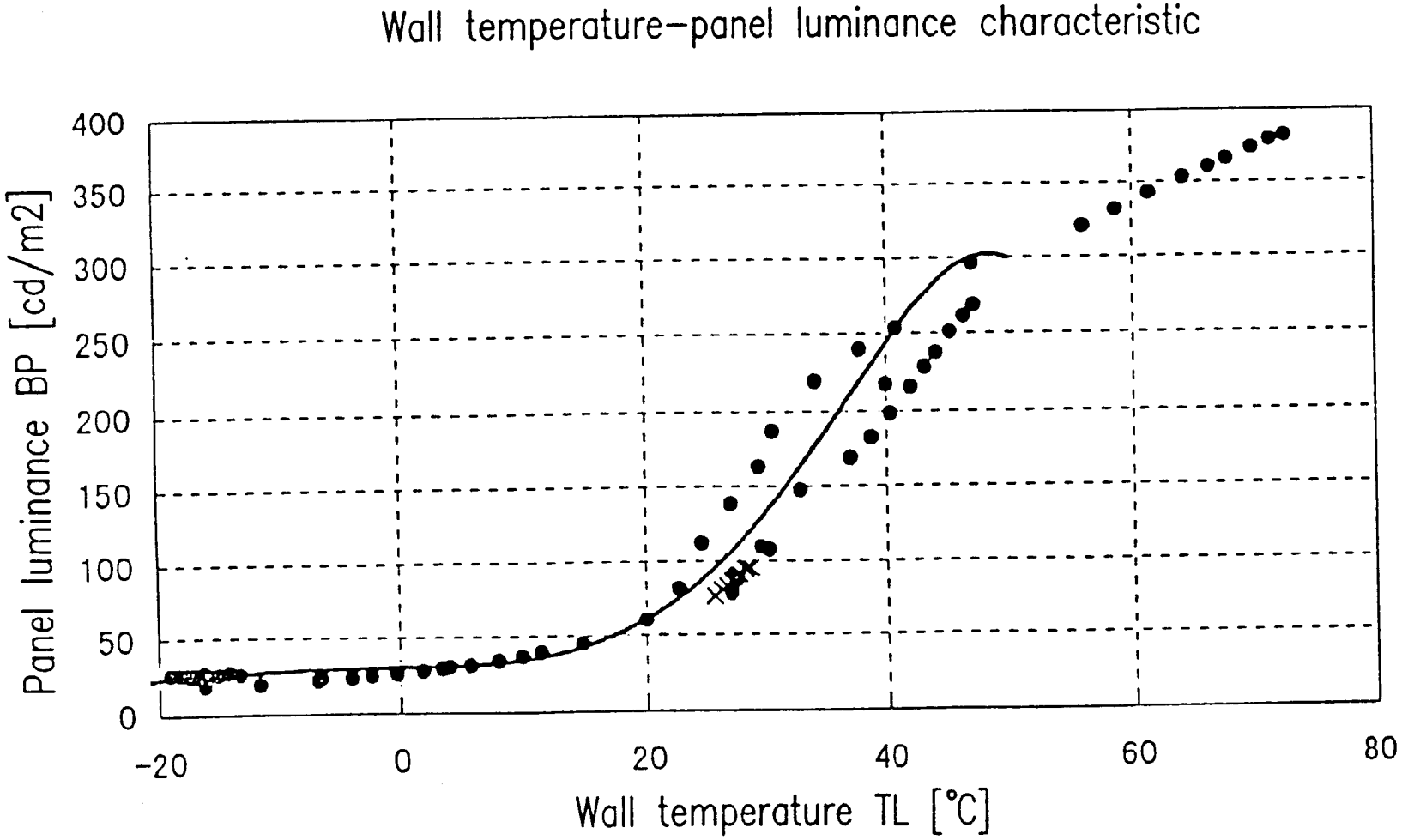
FIG. 18 is a graph showing a relation between luminance and luminance at a panel plane and a wall temperature of the cold cathode fluorescent tube in the illumination device according to the second embodiment.

FIG. 18 shows a relation between a temperature TL of the wall of the cold cathode fluorescent tube 1 and luminance at the panel plane of the liquid crystal display element 8. This graph shows the result of the experiment conducted using the respective devices of FIGS. 1A, 1C and 14. In this experiment, the above-mentioned expression (6) was used for approximation.

Figure 19:
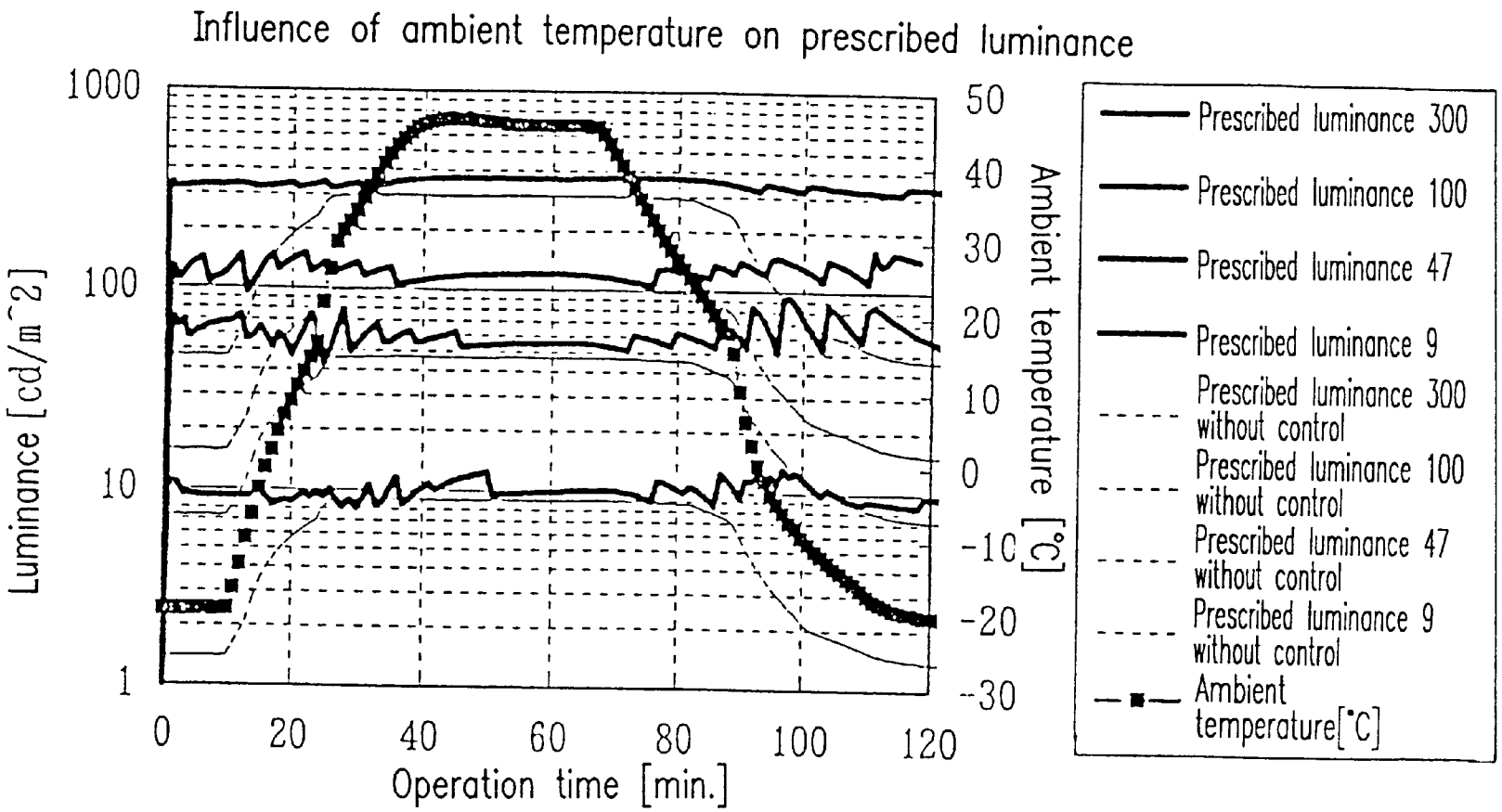
FIG. 19 is a graph showing a result of light modulation according to the second embodiment of the present invention.

FIG. 19 is a graph showing respective actual luminance values with respect to prescribed luminance values at an ambient temperature ta ranging from −20° C. to 45° C. In FIG. 19, luminance values obtained when the control as described above was conducted are shown in comparison with those obtained when no control was conducted. In this experiment, a thermistor was used as the temperature sensor 9. As can be seen from FIG. 19, by controlling the cold cathode fluorescent tube 1 in a manner as described above in the present embodiment, luminance close to each of prescribed luminance values 300 [cd/m$^2$], 100 [cd/m$^2$], 47 [cd/m$^2$] and 9 [cd/m$^2$] can be obtained. As a result, light can be accurately modulated at any ambient temperature. More specifically, according to the present embodiment, approximately constant luminance was obtained for any prescribed luminance at any ambient temperature during operation in the range from 0 to 120 minutes. On the other hand, in the case where the control for the cold cathode florescent tube as described above in the present embodiment is not conducted, luminance is affected by an ambient temperature and luminance variation is significant for any prescribed luminance.

It can be seen from FIG. 19 that, in the present embodiment, light can be modulated even when thermal equilibrium has not been attained right after the start of the cold cathode fluorescent tube 1.

Figure 20:
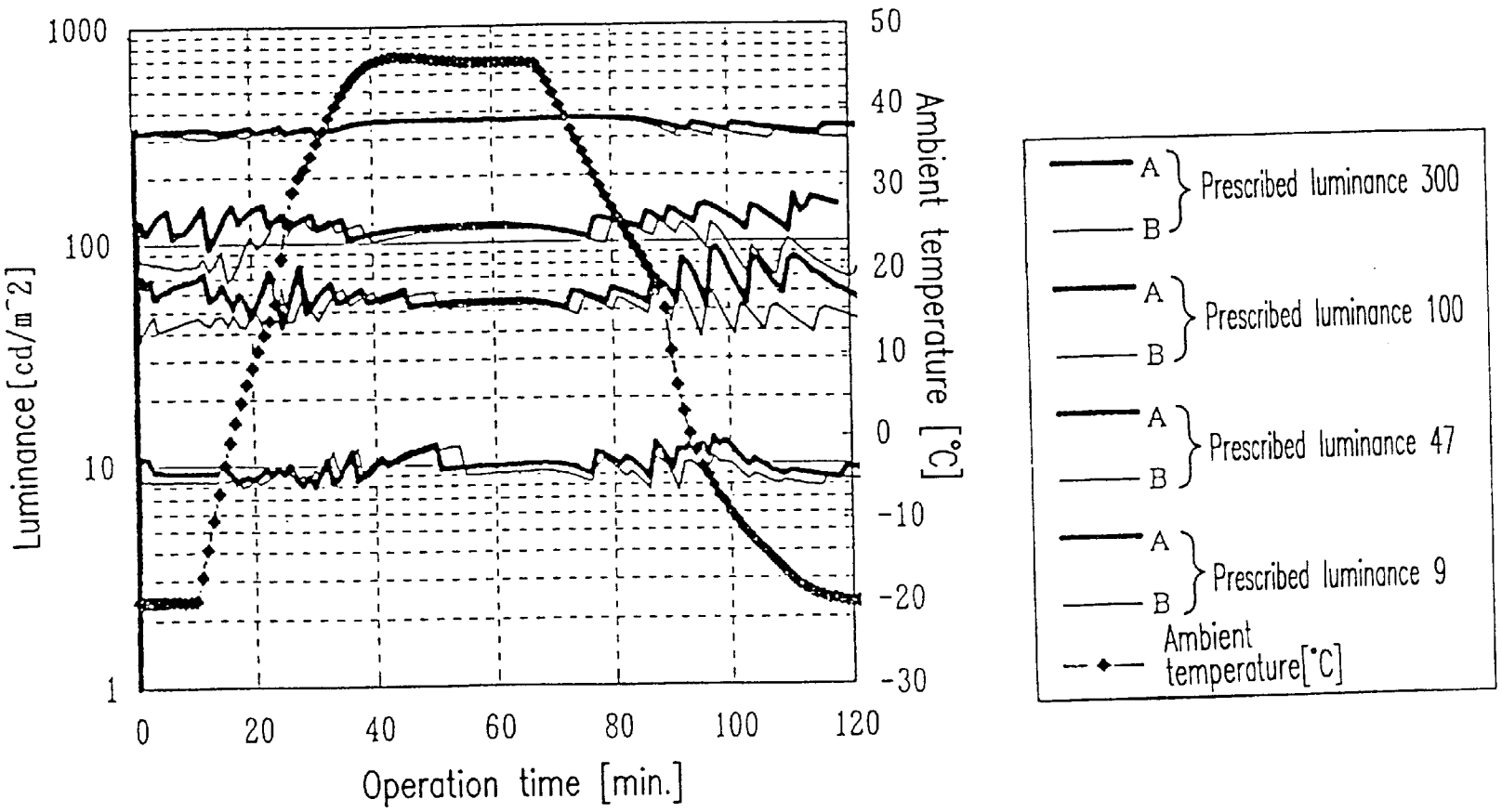
FIG. 20 is a graph showing a result of control conducted in the case where cold cathode fluorescent tubes generating different amounts of heat are used in the second embodiment.

FIG. 20 shows a result of an experiment conducted using the cold cathode fluorescent tubes of different types, that is, two cold cathode fluorescent tubes generating different amounts of heat are used as the cold cathode fluorescent tubes 1 and 1. It can be seen from FIG. 20 that, in this case as well, light can be accurately modulated by conducting the above-mentioned control of the present invention. Note that, in FIG. 20, A represents luminance of a cold cathode fluorescent tube generating a large amount of heat, and B represents luminance of a cold cathode fluorescent tube having a filling-gas pressure which is lower by about 10% of that of the above-mentioned cold cathode fluorescent tube generating a large amount of heat.

In the case where the polarization selective reflection sheet 6 described in the first embodiment is used in the second embodiment, effects similar to those in the first embodiment can be obtained.

The present invention is not limited to the second embodiment described above. The present invention may be structured such that a larger amount of power is supplied to the cold cathode fluorescent tube 1 upon start-up than during a normal operation. Such a structure has an advantage that a start-up characteristic of the cold cathode fluorescent tube 1 is improved.

According to the illumination device of the second embodiment of the present invention, light can be modulated so that intended luminance can be stably achieved at any ambient temperature. Moreover, light modulation can be conducted even when saturation luminance of the cold cathode fluorescent tube has not been obtained, and light modulation can be controlled right after the start-up. Therefore, such an illumination device is particularly preferable when applied to an on-vehicle display device.

Moreover, since the illumination device of the second embodiment is structured such that a larger amount of power is supplied to the cold cathode fluorescent tube upon start-up than during a normal operation a start-up characteristic of the cold cathode fluorescent tube can be improved, whereby intended luminance can be achieved rapidly.

Moreover, a heat capacity of the cold cathode fluorescent tube can be reduced as much as possible and an optimal start-up luminance characteristic can be obtained. Therefore, intended luminance can be achieved rapidly.

Moreover, luminous flux from the cold cathode fluorescent tube can be effectively utilized.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. An illumination device, comprising a cold cathode fluorescent tube having a heat capacity of about 0.035 Wsec/° C. or less per unit length (1 cm) of a glass tube of a fluorescent section of the cold cathode fluorescent tube, wherein about 95% or more of a total surface area of the fluorescent section of the cold cathode fluorescent tube is exposed to air, and wherein about 50% or more of light emitted from the cold cathode fluorescent tube is utilized for illumination.

2. An illumination device according to claim 1, wherein a structure-factor time constant τs given by a product of heat resistance R (° C./W) and the heat capacity C (Wsec/° C.) per unit length (1 cm) of the glass tube of the fluorescent section of the cold cathode fluorescent tube is about 11 seconds or less, where $R=(Ts-T)/\{(Vccft-vp)\cdot Iccft/L\}$, Vccft is a voltage (Vrms) across the cold cathode fluorescent tube, Vp is a voltage drop (Vrms) between electrodes of the cold cathode fluorescent tube, Iccft is a current (Arms) applied to the cold cathode fluorescent tube, L is a length (cm) of the cold cathode fluorescent tube, T is an ambient temperature (° C.), and Ts is a saturation temperature (° C.) of a wall of the cold cathode fluorescent tube, the saturation temperature being a temperature reached when the wall of the cold cathode fluorescent tube attains a steady state while the cold cathode fluorescent tube is in operation.

3. An illumination device according to claim 1, wherein a relation $Dt/Dg<2/da$ is satisfied where a cross sectional area of the glass tube of the cold cathode fluorescent tube is represented by Dt ($mm^2$), a cross sectional area of a gas-filled portion of the cold cathode fluorescent tube is represented by Dg ($mm^2$), and an inner diameter of the glass tube is represented by da ($mm^2$).

4. An illumination device according to claim 1, wherein a relation $Wv/Iccft \geqq 0.5$ is satisfied where an amount of heat generation per unit volume (1 $cm^3$) of the glass tube of the fluorescent section of the cold cathode fluorescent tube is represented by Wv(W) and a current across the cold cathode fluorescent tube is represented by Iccft (mArms).

5. An illumination device according to claim 1, wherein a time constant τ for a luminance rise of the cold cathode fluorescent tube satisfies a relation $\tau \leqq -0.0006T^3+0.0288T^2-0.4668T+26.8$ at an ambient temperature T (° C.) upon start-up of the cold cathode fluorescent tube ranging from −10° C. to +25° C.

6. An illumination device according to claim 5, wherein a pre-exponential factor A of a luminance rising characteristic of the cold cathode fluorescent tube satisfies a relation $A \geqq 0.92T+60$ within the start-up ambient temperature range, the pre-exponential factor A being represented as a percentage with respect to a pre-exponential factor A0 of saturation relative luminance.

7. An illumination device according to claim 6, wherein the activation energy of the pre-exponential factor of the cold cathode fluorescent tube is about 3.0 kcal/mol or less within the start-up ambient temperature range.

8. An illumination device according to claim 1, further comprising:

a polarization selective reflection sheet provided on a light-emitting side of the cold cathode fluorescent tube.

9. An illumination device according to claim 1, wherein during operation of the illumination device, a constant current is applied to the cold cathode fluorescent tube.

10. An illumination device according to claim 1, further comprising:

a temperature detector for detecting an ambient temperature of the cold cathode fluorescent tube; and an operation apparatus for setting a prescribed current applied to the cold cathode fluorescent tube, based on the temperature detected by the temperature detector, wherein the current applied to the cold cathode fluorescent tube is controlled based on an ambient temperature upon start-up of the cold cathode fluorescent tube.

11. A method for driving an illumination device according to claim 1, comprising the steps of:

detecting an ambient temperature of the cold cathode fluorescent tube by the temperature detector;

setting a prescribed current applied to the cold cathode fluorescent tube, based on the temperature detected by the temperature detector; and thereby controlling the current applied to the cold cathode fluorescent tube, based on an ambient temperature upon start-up of the cold cathode fluorescent tube.

12. A display device, comprising:

an illumination device according to claim 1; and a transmission-type display element for receiving light emitted from the illumination device.

13. A display device according to claim 1; wherein the transmission-type display element is a liquid crystal display device.

14. An illumination device according to claim 1, comprising:

a temperature sensor thermally coupled to the cold cathode fluorescent tube, wherein luminance is adjusted by controlling power supplied to the cold cathode fluorescent tube based on a sensed-temperature signal from the temperature sensor.

15. A method for driving an illumination device according to claim 1, comprising the steps of:

sensing a temperature of the cold cathode fluorescent tube; and controlling power supplied to the cold cathode fluorescent tube, based on the sensed temperature, thereby adjusting luminance.

16. An illumination device including a cold cathode fluorescent tube, comprising:

a temperature sensor thermally coupled to the cold cathode fluorescent tube, wherein luminance is adjusted by controlling power supplied to the cold cathode fluorescent tube based on a sensed-temperature signal from the temperature sensor and by approximating a relation between luminance and a temperature sensed by the temperature sensor by one of expressions of a first order which are provided for respective temperature ranges, and controlling a duty ratio of the power supplied to the cold cathode fluorescent tube based on the expression, respectively.

17. An illumination device according to claim 16, wherein the temperature sensor is provided at a portion of a wall of the cold cathode flourescent tube.

18. An illumination device according to claim 17, wherein the wall is a wall located in a direction outward within the illumination device.

19. An illumination device according to claim 17, wherein the temperature sensor is provided at a corner of a display plane.

20. An illumination device according to claim 16, wherein a larger amount of power is supplied to the cold cathode fluorescent tube upon start-up than during a normal operation.

21. An illumination device according to claim 16, wherein a heat capacity of the cold cathode fluorescent tube is reduced by decreasing a diameter of the cold cathode fluorescent tube as much as possible or by decreasing a size of the cold cathode fluorescent tube as much as possible.

22. A display device using an illumination device according to claim 16.

23. An illumination device including a cold cathode fluorescent tube, comprising:

a temperature sensor thermally coupled to the cold cathode fluorescent tube, wherein luminance is adjusted by controlling power supplied to the cold cathode fluorescent tube based on a sensed-temperature signal from the temperature sensor and by approximating a relation between luminance and a temperature sensed by the temperature sensor by a polynomial, and controlling a duty ratio of the power supplied to the cold cathode fluorescent tube based on the polynomial.

* * * * *